US011359310B2

(12) United States Patent
Hamanaka et al.

(10) Patent No.: US 11,359,310 B2
(45) Date of Patent: Jun. 14, 2022

(54) FALSE TWIST YARN COMPRISING DYEABLE POLYOLEFIN FIBERS

(71) Applicant: Toray Industries, Inc., Tokyo (JP)

(72) Inventors: Shogo Hamanaka, Mishima (JP); Hidekazu Kano, Mishima (JP); Katsuhiko Mochizuki, Mishima (JP)

(73) Assignee: Toray Industries, Inc., Tokyo (JP)

( * ) Notice: Subject to any disclaimer, the term of this patent is extended or adjusted under 35 U.S.C. 154(b) by 794 days.

(21) Appl. No.: 16/325,118

(22) PCT Filed: Aug. 3, 2017

(86) PCT No.: PCT/JP2017/028184
§ 371 (c)(1),
(2) Date: Feb. 12, 2019

(87) PCT Pub. No.: WO2018/034160
PCT Pub. Date: Feb. 22, 2018

(65) Prior Publication Data

US 2021/0172094 A1 Jun. 10, 2021

(30) Foreign Application Priority Data

Aug. 18, 2016 (JP) ..... JP2016-160744

(51) Int. Cl.

| | |
|---|---|
| ***D02G 3/04*** | (2006.01) |
| ***D01F 8/06*** | (2006.01) |
| ***D01F 8/14*** | (2006.01) |
| ***D02G 1/02*** | (2006.01) |

(52) U.S. Cl.
CPC ..... *D02G 3/045* (2013.01); *D01F 8/06* (2013.01); *D01F 8/14* (2013.01); *D02G 1/0206* (2013.01); *D10B 2401/14* (2013.01)

(58) Field of Classification Search
CPC ..... D02G 3/045; D02G 1/0206; D01F 8/06; D01F 8/14; D10B 2401/14
See application file for complete search history.

(56) References Cited

U.S. PATENT DOCUMENTS

| | | | | |
|---|---|---|---|---|
| 6,132,868 | A | 10/2000 | Dean et al. | |
| 6,399,194 | B1 * | 6/2002 | Kunisada | D02G 1/02 57/247 |
| 2005/0217037 | A1 | 10/2005 | Negola | |
| 2007/0166509 | A1 * | 7/2007 | Horiguchi | B32B 5/26 442/268 |
| 2019/0055674 | A1 * | 2/2019 | Tanaka | D02G 3/04 |

FOREIGN PATENT DOCUMENTS

| | | | | | |
|---|---|---|---|---|---|
| JP | 4-209824 | A | | 7/1992 | |
| JP | 7-90783 | A | | 4/1995 | |
| JP | 7-189036 | A | | 7/1995 | |
| JP | 2001-522947 | A | | 11/2001 | |
| JP | 2005256268 | A | * | 9/2005 | B32B 3/30 |
| JP | 2008-63671 | A | | 3/2008 | |
| JP | 2008-533315 | A | | 8/2008 | |
| JP | 2008-538391 | A | | 10/2008 | |
| JP | 2009-41124 | A | | 2/2009 | |
| JP | 2009046785 | A | * | 3/2009 | G03G 15/00 |
| JP | 2009179899 | A | * | 8/2009 | A47G 27/02 |
| WO | WO-2013141033 | A1 | * | 9/2013 | C04B 24/38 |
| WO | 2017/154665 | A1 | | 9/2017 | |

* cited by examiner

*Primary Examiner* — Shaun R Hurley
*Assistant Examiner* — Patrick J. Lynch
(74) *Attorney, Agent, or Firm* — DLA Piper LLP (US)

(57) ABSTRACT

A false twist yarn includes dyeable polyolefin fibers characterized as being polymer alloy fibers each having a sea-island structure in which a polyolefin (A) is the sea component and a polyester (B) having cyclohexanedicarboxylic acid compolymerized therein is the island component, and in which the dispersion diameter of the island component in a fiber cross section is 30-1000 nm, wherein the number of the polymer alloy fibers is three or more, and the polymer alloy fibers have physical properties (1) and (2): (1) crimp recovery (CR) being 10-40%; and (2) hot-water dimensional change being 0.0-7.0%. The polyolefin false twist yarn is capable of developing vivid and profound colors even though the polyolefin fibers therein are light in weight.

4 Claims, No Drawings

FALSE TWIST YARN COMPRISING DYEABLE POLYOLEFIN FIBERS

TECHNICAL FIELD

This disclosure relates to a false-twisted yarn formed mainly of a dyeable polyolefin fiber. More specifically, it relates to a false-twisted yarn formed of a dyeable polyolefin fiber processed by imparting a vivid, deep color developability and bulky property suitable for clothing material applications to a highly lightweight polyolefin fiber to serve suitably as a fiber structure.

BACKGROUND

Polyethylene fiber and polypropylene fiber, which fall under the category of polyolefin fiber, are light in weight and high in chemical resistance, but have the disadvantage of being difficult to dye due to the absence of polar functional groups. These disadvantages make them unsuitable as clothing material and accordingly they are currently used in a limited range of applications including interior materials such as tile carpets, household carpets, and automobile mats, and general materials such as ropes, protective nets, filter fabrics, narrow tapes, braids, and chair upholstery.

Adding a pigment is a simple dyeing method for polyolefin fibers. The use of a pigment, however, cannot serve effectively to develop vivid or light colors stably as compared to the use of a dye, and there is the disadvantage that pigments tend to stiffen fibers, leading to products with low softness.

As a dyeing method to replace the use of pigments, there is a proposal of surface modification of polyolefin based fibers. For example, Japanese Unexamined Patent Publication (Kokai) No. HEI 7-90783 describes an attempt at improving dyeing properties through surface modification of polyolefin fibers by performing ozone treatment or ultraviolet ray exposure to cause graft copolymerization with vinyl compounds.

In addition, there are proposals of techniques that combine a low-dyeability polyolefin with a dyeable polymer to form a composite material. For example, Japanese Unexamined Patent Publication (Kokai) No. HEI 4-209824 proposes a dyeable polyolefin fiber produced by blending a polyolefin with a polyester or polyamide as dyeable polymer.

In addition, Published Japanese Translation of PCT International Publication JP 2008-533315 and Published Japanese Translation of PCT International Publication JP 2001-522947 each propose a blend of a polyolefin with an amorphous dyeable polymer to realize improved color developability. More specifically, Published Japanese Translation of PCT International Publication JP 2008-533315 proposes the use of a polyester copolymerized with cyclohexanedimethanol and Published Japanese Translation of PCT International Publication JP 2001-522947 proposes the use of a polyester copolymerized with isophthalic acid and cyclohexanedimethanol, as a dyeable amorphous polymer to be blended with a polyolefin to provide a dyeable polyolefin fiber.

In addition, Japanese Unexamined Patent Publication (Kokai) No. 2008-63671 proposes a dyeable polypropylene based crimped fiber composed mainly of a saturated polyester resin, a modified polypropylene resin, and an unmodified polypropylene resin to serve as a dyeable bulky polyolefin fiber.

The method described in Japanese Unexamined Patent Publication (Kokai) No. HEI 7-90783, however, requires a long processing time for ozone treatment and ultraviolet ray exposure, leading to low productivity and difficulties in industrialization.

Regarding the methods described in Japanese Unexamined Patent Publication (Kokai) No. HEI 4-209824 and Japanese Unexamined Patent Publication (Kokai) No. 2008-63671, although they can impart color developability to polyolefin fibers by adding dyeable polymers, those dyeable polymers are crystalline and low in color developability, failing to develop required vivid or deep colors. The methods proposed in Published Japanese Translation of PCT International Publication JP 2008-533315 and Published Japanese Translation of PCT International Publication JP 2001-522947 can realize improved color developability as a result of the use of amorphous dyeable polymers, but they cannot develop sufficiently vivid or deep colors. The method proposed in Japanese Unexamined Patent Publication (Kokai) No. 2008-63671 is designed for fibers to serve as material for carpets, which do not have sufficiently high flexibility or good texture to serve as clothing material.

Furthermore, if a polymer alloy fiber is prepared from a polyolefin and a polymer that is incompatible with the polyolefin and processed by false-twisting, they are separated easily at the interface between them, resulting in yarns with very low quality suffering from deterioration in wear resistance, transparency, color developability, strength, and crimp recovery.

It could therefore be helpful to provide a false-twisted yarn formed of a dyeable polyolefin fiber processed by imparting color developability for vivid, deep colors and bulkiness required for clothing applications to a highly lightweight polyolefin fiber to serve suitably as a fiber structure.

SUMMARY

We thus provide a false-twisted yarn and a fiber structure formed thereof, including dyeable polyolefin fibers containing three or more polymer alloy fiber filaments, meeting the following physical property features (1) and (2), and having a sea-island structure composed mainly of a polyolefin (A) as sea component and a polyester (B) copolymerized with cyclohexanedicarboxylic acid as island component, the island component having a dispersed particle diameter of 30 to 1,000 nm in the fiber cross section:

(1) a crimp recovery rate (CR) of 10% to 40%, and (2) hot-water dimensional change rate of 0.0% to 7.0%.

In the polyester (B), 10 to 50 mol % of all dicarboxylic acid components are preferably copolymerized with cyclohexanedicarboxylic acid.

It is preferable that the yarn further includes a compatibilizer (C) and that the polyester (B) accounts for 3.0 to 20.0 parts by weight in the total quantity of the polyolefin (A), polyester (B), and compatibilizer (C), which accounts for 100 parts by weight.

We provide a false-twisted yarn formed of dyeable polyolefin fibers that is high in color developability for vivid, deep colors in spite of being very light in weight.

DETAILED DESCRIPTION

The false-twisted yarn including dyeable polyolefin fibers contains three or more polymer alloy fiber filaments having a sea-island structure composed mainly of a polyolefin (A) as sea component and a polyester (B) copolymerized with cyclohexanedicarboxylic acid as island component, the island component having a dispersed particle diameter of 30 to 1,000 nm in the fiber cross section and having the physical property features (1) and (2) described below.

(1) a crimp recovery rate (CR) of 10% to 40%, and (2) hot-water dimensional change rate of 0.0% to 7.0%.

A polyester (B) copolymerized with cyclohexanedicarboxylic acid, which works as a dyeable polymer, exists in the island component in the polyolefin (A) and this allows a false-twisted yarn containing the polyolefin (A) to have color developability. Unlike when a dyeable polymer is present in the core of a sheath-core composite fiber or in the islands of a sea-island composite fiber, the dyeable polymer used as island component in a polymer alloy fiber is exposed at the fiber surface, allowing the fiber to have a higher color developability. In addition, this improves the efficiency in color development by light permeating into the island component, resulting in vivid, deep color development.

A polymer alloy fiber is one that contains an island component in a discontinuously dispersed state. The term "an island component in a discontinuously dispersed state" means that each island has an appropriate length to allow the sea-island structure to show different features in sections perpendicular to the fiber axis, i.e., the fiber's cross sections, located at random intervals in one single yarn. The discontinuous state of an island component can be determined by the method described in the Examples. When an island component is in a discontinuously dispersed state, the islands, which have a spindle shape, improve efficiency in color development by light permeating into the island component, resulting in improved vivid color features and deep color development. Thus, the polymer alloy fiber is essentially different from the sheath-core composite fiber in which one island extends continuously in the fiber axis direction in an identical shape or the sea-island composite fiber in which a plurality of islands having identical shapes are located continuously in the fiber axis direction. Such a polymer alloy fiber can be obtained, for example, at an appropriate stage before the completion of melt-spinning when molding a polymer alloy composition prepared by kneading the polyolefin (A) and the polyester (B) copolymerized with cyclohexanedicarboxylic acid.

In the false-twisted yarn including a dyeable polyolefin fiber, the island component has a dispersed particle diameter of 30 to 1,000 nm in the fiber cross section of the constituent polymer alloy fiber. The dispersed particle diameter of the island component in the fiber cross section is determined by the method described in the Examples. If the dispersed particle diameter of the island component in the fiber cross section is 30 nm or more, the fixation of the dye after exhaustion by the polyester (B) in the island component serves to improve the efficiency in color development by light permeating into the island component, resulting in vivid, deep color development. If the dispersed particle diameter of the island component in the fiber cross section is 1,000 nm or less, on the other hand, the area of the sea-island interface can be increased largely enough to prevent boundary separation and abrasion attributable thereto, leading to a dyed yarn with a high friction fastness. As the island component has a smaller dispersed particle diameter, the coagulation of the dye compound is depressed more efficiently to ensure a more monodisperse state. This serves for larger improvement in color development efficiency to realize the production of a dyed yarn with a higher color fastness to light and color fastness to washing. When melt-spinning the polyolefin fiber, furthermore, a high spinnability will be achieved. Thus, the dispersed particle diameter of the island component in the fiber cross section is preferably 700 nm or less, still more preferably 500 nm or less, and particularly preferably 300 nm or less.

The false-twisted yarn of a dyeable polyolefin fiber is characterized by a crimp recovery rate (CR) of 10% to 40%. The crimp recovery rate (CR) is determined by the method specified in JIS L1013 (2010) 8.12.

A higher crimp recovery rate (CR) is preferable because a higher bulkiness can be realized when the false-twisted yarn of a dyeable polyolefin fiber is applied to knitted fabrics for clothing. Thus, the crimp recovery rate (CR) should be 10% or more, preferably 15% or more, and more preferably 20% or more. On the other hand, it is sometimes difficult to perform stable industrial production of a false-twisted yarn with a crimp recovery rate (CR) of more than 40%. Substantially, the lower limit of the crimp recovery rate (CR) is 0%.

The false-twisted yarn of a dyeable polyolefin fiber is characterized by a hot-water dimensional change rate of 0.0% to 7.0%. The hot-water dimensional change rate is determined by the method specified in JIS L1013 (2010) 8.18.1 (hot-water dimensional change rate: rate of change in hank size (A-method)).

If the hot-water dimensional change rate is in the above range, the heat shrinkage during dyeing will be depressed to ensure a high dimensional stability and prevent a decrease in flexibility when producing woven knitted fabrics from the false-twisted yarn of a dyeable polyolefin fiber. Accordingly, the hot-water dimensional change rate is more preferably 6.0% or less and still more preferably 5.0% or less. The hot-water dimensional change rate is preferably as small as possible, but a value of smaller than 0.0 (i.e., a negative value) is not preferable from the viewpoint of dimensional stability because heated elongation can occur during dyeing when woven knitted fabrics are produced from the false-twisted yarn of a dyeable polyolefin fiber.

In the false-twisted yarn of a dyeable polyolefin fiber, the sea component of the sea-island structure is a polyolefin (A). Polyolefins are low in specific gravity and serve to produce lightweight fibers. Examples of the polyolefin (A) include, but not limited to, polyethylene, polypropylene, polybutene-1, and polymethylpentene. In particular, polypropylene is preferable because of high molding processability and good mechanical characteristics, and polymethylpentene is preferable because of high melting point, high heat resistance, and high lightness because of lower specific gravity than any other polyolefins. From the viewpoint of strength and bulkiness, polypropylene can be adopted particularly suitably.

The polyolefin (A) may be either a homopolymer or a copolymer with other α-olefins. Such a copolymer may contain only one or a plurality of such other α-olefins (hereinafter occasionally referred to simply as α-olefins).

Such an α-olefin preferably contains 2 to 20 carbon atoms and the molecular chain of the α-olefin may be either a straight chain or a branched chain. Specific examples of these α-olefins include, but not limited to, ethylene, propylene, 1-butene, 1-pentene, 1-hexene, 1-octene, 1-decene, 1-dodecene, 1-tetradecene, 1-hexadecene, 1-octadecene, 1-eicosene, 3-methyl-1-butene, 3-methyl-1-pentene, 3-ethyl-1-pentene, and 3-ethyl-1-hexene.

The α-olefin copolymerization ratio is preferably 20 mol % or less. An α-olefin copolymerization ratio of 20 mol % or less is preferable because it enables the production of a false-twisted yarn of a dyeable polyolefin fiber that has good mechanical characteristics and high heat resistance. The α-olefin copolymerization ratio is more preferably 15 mol % or less and still more preferably 10 mol % or less.

In the false-twisted yarn of a dyeable polyolefin fiber, the island component of the sea-island structure is a polyester (B) copolymerized with cyclohexanedicarboxylic acid.

There are two good methods to improve the color developability of a fiber: one is to decrease the crystallinity of the polymer that constitutes the fiber and the other is to decrease the refractive index of the polymer, of which decreasing the refractive index of the polymer can be more effective.

Dyes are less easily exhausted by crystal portions whereas they are easily exhausted by amorphous portions, and accordingly the polymer is preferably as low in crystallinity as possible, and more preferably amorphous, from the viewpoint of color developability improvement. In Published Japanese Translation of PCT International Publication JP 2008-533315 and Published Japanese Translation of PCT International Publication JP 2001-522947, for example, an amorphous copolyester copolymerized with cyclohexanedimethanol is combined with a polyolefin to form a composite in an attempt to produce a polyolefin fiber having color developability.

When a fiber of a polymer with a lower refractive index is used, the amount of light reflected from the fiber surface will decrease and accordingly, a sufficient amount of light will penetrate to the interior of the fiber to development of vivid, deep color developability. An effective way to obtain a polymer with a lower refractive index is to decrease the aromatic ring concentration in the polymer. The aromatic ring concentration in a polymer is calculated by the equation below from the copolymerization rate (mol %) of the copolymerization component having an aromatic ring and the molecular weight (g/mol) of the repeating unit.

Aromatic ring concentration (mol/kg)=copolymerization rate (mol %) of copolymerization components having aromatic rings×10/molecular weight of repeating units (g/mol).

Polyethylene terephthalate (PET), for example, is a copolymer of terephthalic acid and ethylene glycol and terephthalic acid is the copolymerization component having an aromatic ring. In Published Japanese Translation of PCT International Publication JP 2008-533315 and Published Japanese Translation of PCT International Publication JP 2001-522947, which propose the use of a polyester prepared by copolymerizing PET with cyclohexanedimethanol, the copolymerization rate of the copolymerization component having an aromatic ring is the same as for PET, and the molecular weight of the repeating unit is larger than that for PET. As a result, the aromatic ring concentration calculated by the above equation is slightly smaller than that for PET, leading to a slightly lower refractive index than for PET. Since the methods proposed in Published Japanese Translation of PCT International Publication JP 2008-533315 and Published Japanese Translation of PCT International Publication JP 2001-522947 have the problem of insufficient color developability for vivid, deep colors, we made intensive studies with the aim of solving this problem and arrived at the idea of copolymerizing PET with cyclohexanedicarboxylic acid to obtain a copolyester with a low refractive index. Specifically, if PET is copolymerized with cyclohexanedicarboxylic acid, the copolymerization rate of the copolymerization component having an aromatic ring will be lower than that for PET and at the same time, the molecular weight of the repeating unit will be higher than that for PET. As a result, the aromatic ring concentration calculated by the above equation will be smaller and the refractive index will also be lower than in copolymerization with cyclohexanedimethanol, leading to a higher color developability and more effective vivid, deep color development.

The false-twisted yarn of a dyeable polyolefin fiber is characterized by containing three or more filaments (polymer alloy fibers as described above). The existence of 3 or more filaments serves to realize a required degree of twisting during the false-twisting step to ensure a crimp recovery rate in the range specified. An appropriate number of filaments may be adopted to suit the relevant purpose, uses, and required characteristics, but the number is preferably 6 or more and more preferably 12 or more from the viewpoint of false-twistability and flexibility. There are no specific limitations on the upper limit of the number of filaments, but as the number of filaments increases, the false-twisted yarn of a dyeable polyolefin fiber will be lower in level dyeability, and accordingly, it is preferably 250 or less, more preferably 200 or less, and still more preferably 150 or less.

In the polyester (B), 10 to 50 mol % of all dicarboxylic acid components are preferably copolymerized with cyclohexanedicarboxylic acid. The polyester (B) is a polycondensate containing three or more components selected from dicarboxylic acid components and diol components. However, when all dicarboxylic acid components are in the form of cyclohexanedicarboxylic acid, that is, when cyclohexanedicarboxylic acid accounts for 100 mol %, the substance is deemed to be a copolyester (B) regardless of whether it contains only one or a plurality of diol components. The cyclohexanedicarboxylic acid copolymerization rate is preferably high, because as it increases, the polyester (B) will be lower in refractive index and the false-twisted yarn of a dyeable polyolefin fiber will increase in color developability. A cyclohexanedicarboxylic acid copolymerization rate of 10 mol % or more is preferable because it serves to produce a polymer characterized by a low refractive index and effective vivid, deep color development. The cyclohexanedicarboxylic acid copolymerization ratio is more preferably 15 mol % or more and still more preferably 20 mol % or more. Furthermore, a cyclohexanedicarboxylic acid copolymerization rate of 30 mol % or more is particularly preferable because the resulting polymer will be amorphous and a larger amount of dye will be exhausted by the polymer, thereby ensuring a higher color developability.

If the cyclohexanedicarboxylic acid copolymerization rate is 50 mol % or less, on the other hand, it ensures good process passing property in high-order processing steps, and the resulting false-twisted yarn of a dyeable polyolefin fiber will have a small fineness variation value U % (hi). In addition, it also ensures a high level dyeability in the dyeing step, a high color fastness to light, and a high color fastness to washing. Therefore, the cyclohexanedicarboxylic acid copolymerization rate is preferably 50 mol % or less, more preferably 45 mol % or less, and still more preferably 40 mol % or less. The cyclohexanedicarboxylic acid may be any of 1,2-cyclohexanedicarboxylic acid, 1,3 -cyclohexanedicarboxylic acid, and 1,4-cyclohexanedicarboxylic acid, which may be used singly or as a mixture of two or more thereof. In particular, the adoption of 1,4-cyclohexanedicarboxylic acid is preferable from the viewpoint of heat resistance and mechanical characteristics.

The polyester (B) may be copolymerized with other copolymerization components and specific examples include, but not limited to, aromatic dicarboxylic acids such as terephthalic acid, phthalic acid, isophthalic acid, 5-sodium sulfoisophthalic acid, 1,5-naphthalene dicarboxylic acid, 2,6-naphthalene dicarboxylic acid, 2,2'-biphenyl dicarboxylic acid, 3,3'-biphenyl dicarboxylic acid, 4,4'-biphenyl dicarboxylic acid, and anthracene dicarboxylic acid; aliphatic dicarboxylic acids such as malonic acid, fumaric acid, maleic acid, succinic acid, itaconic acid, adipic acid, azelaic acid, sebacic acid, 1,11-undecane dicarboxylic acid, 1,12-dodecane dicarboxylic acid, 1,14-tetradecane dicarboxylic acid, 1,18-octadecane dicarboxylic acid, 1,2-cyclohexane dicarboxylic acid, 1,3-cyclohexane dicarboxylic acid, and dimer acid; aromatic diols such as catechol, naphthalene diols, and bisphenol; and aliphatic diols such as ethylene glycol, trimethylene glycol, tetramethylene glycol, hexamethylene glycol, diethylene glycol, polyethylene glycol, polypropylene glycol, neopentyl glycol, and cyclohexane dimethanol. These copolymerization components may be used singly, or two or more thereof may be used in combination.

A compatibilizer (C) may be provided with the aim of producing a false-twisted yarn with an improved color developability. The addition of a compatibilizer (C) works to improve the dispersibility of the polyester (B) of the island component and improve the interface adhesion between the sea component and the island component, thereby serving to provide a false-twisted yarn with a higher color developability.

It is preferable that the false-twisted yarn of a dyeable polyolefin fiber further includes a compatibilizer (C) and that the polyester (B) accounts for 3.0 to 20.0 parts by weight in the total quantity of the polyolefin (A), polyester (B), and compatibilizer (C), which accounts for 100 parts by weight.

If the polyester (B) accounts for 3.0 parts by weight or more, it means that the polyester (B), which is low in refractive index and high in color developability, is scattered in the polyolefin (A), which is low in refractive index, thereby realizing vivid, deep color development. It is more preferable for the polyester (B) to account for 4.0 parts by weight or more, still more preferably 5.0 parts by weight or more. On the other hand, a polyester (B) content of 20.0 parts by weight or less is preferable because the dyeing of the islands, which exist in a larger number than the sea, acts to improve the color development efficiency owing to the light permeation into the islands, thereby realizing vivid, deep color development. Furthermore, it also ensures improvement in color fastness to light, color fastness to washing, and color fastness to rubbing. It is also preferable to prevent the polyolefin (A) from deterioration in lightness, crimp recovery rate, and hot-water dimensional change rate. The polyester (B) content is preferably 17.0 parts by weight or less and more preferably 15.0 parts by weight or less.

An appropriate compatibilizer (C) may be selected to suit the cyclohexanedicarboxylic acid copolymerization rate of the polyester (B), the composite ratio between the polyolefin (A) of the sea component and the polyester (B) of the island component and the like. Such compatibilizers (C) may be used singly, or two or more thereof may be used in combination.

The compatibilizer (C) is preferably a compound containing, in one molecule, both a hydrophobic component having a high affinity for the highly hydrophobic polyolefin (A) of the sea component and a functional group having a high affinity for the polyester (B) of the island component. In addition, a compound that contains, in one molecule, both a hydrophobic component having a high affinity for the highly hydrophobic polyolefin (A) of the sea component and a functional group having a reactivity to the polyester (B) of the island component can also be used suitably as the compatibilizer (C).

Specific examples of the hydrophobic component contained in a compatibilizer (C) include, but not limited to, polyolefin resins such as polyethylene, polypropylene, and polymethylpentene; acrylic resins such as polymethyl methacrylate; styrene based resins such as polystyrene; conjugated diene based resins such as ethylene-propylene copolymer, ethylene-butylene copolymer, propylene-butylene copolymer, styrene-butadiene-styrene copolymer, styrene-isoprene-styrene copolymer, styrene-ethylene-butylene-styrene copolymer, styrene-ethylene-propylene-styrene copolymer.

Specific examples of the functional group having a high affinity to the polyester (B) contained in the compatibilizer (C) or the functional group having a reactivity to the polyester (B) include, but not limited to, anhydride groups, carboxyl groups, hydroxyl groups, epoxy groups, amino groups, and imino groups. Of these, amino groups and imino groups are preferable because they are high in reactivity to the polyester (B).

Specific examples of the compatibilizer (C) include, but not limited to, maleic anhydride modified polyethylene, maleic anhydride modified polypropylene, maleic anhydride modified polymethylpentene, epoxy modified polypropylene, epoxy modified polystyrene, maleic anhydride modified styrene-ethylene-butylene-styrene copolymer, amine modified styrene-ethylene-butylene-styrene copolymer, imine modified styrene-ethylene-butylene-styrene copolymer.

It is preferably one or more compounds selected from the group consisting of polyolefin resins, acrylic resins, styrene based resins, and conjugated diene based resins, each containing at least one functional group selected from the group consisting of anhydride groups, carboxyl groups, hydroxyl groups, epoxy groups, amino groups, and imino groups. In particular, the use of a styrene-ethylene-butylene-styrene copolymer containing at least one functional group selected from the group consisting of amino groups and imino groups is preferable because it is high in reactivity to the polyester (B) and highly effective in improving the dispersibility of the polyester (B) in the polyolefin (A) and accordingly, the dyeing of the polyester (B) of the island component can serve to improve the color development efficiency owing to the light permeation into the island component, thereby realizing vivid, deep color development.

If a compatibilizer (C) is added, it is preferable that the compatibilizer (C) in the false-twisted yarn of a dyeable polyolefin fiber preferably accounts for 0.1 to 10 parts by weight relative to the total quantity of the polyolefin (A), polyester (B), and compatibilizer (C), which accounts for 100 parts by weight. A compatibilizer (C) content of 0.1 parts by weight or more is preferable because it can cause the compatibilization between the polyolefin (A) and the polyester (B) and accordingly, the dispersed particle diameter of the island component decreases to depress the coagulation of the dye compound to develop a more monodisperse state, thereby achieving an improved color development efficiency and effective vivid, deep color development. It is also preferable because it realizes an improved yarn-making workability owing to decreased thread breakage and produces a false-twisted yarn that is small in fineness unevenness, high in uniformity in fiber length direction, and high in level dyeability. It is more preferable for the compatibilizer (C) to account for 0.3 parts by weight or more, more preferably 0.5 parts by weight or more. On the other hand, a compatibilizer (C) content of 10.0 parts by weight or less is preferable because it serves to maintain fiber characteristics, appearance, texture and the like, that are attributed to the polyolefin (A) and the polyester (B) contained in the false-twisted yarn of a dyeable polyolefin fiber. It is also preferable because it serves to depress the destabilization in yarn-making workability that may be caused by the compatibilizer if added excessively. It is more preferable for the compatibilizer (C) to account for 7.0 parts by weight or less, more preferably 5.0 parts by weight or more.

The false-twisted yarn of a dyeable polyolefin fiber preferably contains an antioxidant. The incorporation of an antioxidant is preferable because it serves not only to depress the oxidative decomposition of polyolefins due to long term storage and tumbler drying, but also to improve durability relating to fiber characteristics such as mechanical properties.

The antioxidant is preferably one selected from the group consisting of phenol based compounds, phosphorus based compounds, and hindered amine based compounds. These antioxidants may be used singly, or two or more thereof may be used in combination.

The phenol based compounds are radical chain reaction inhibitors having phenol structures, which may be used singly or as a mixture of two or more thereof. Of these, particularly preferable are pentaerythritol-tetrakis(3-(3,5-di-t-butyl-4-hydroxyphenol) propionate) (for example, Irganox 1010, manufactured by BASF), 2,4,6-tris-(3',5'-di-t-butyl-4'-hydroxybenzyl) mesitylene (for example, Adeka Stab AO-330, manufactured by Adeka Corporation), 3,9-bis[1,1-dimethyl-2-[β-(3-t-butyl-4-hydroxy-5-methylphenyl) propionyloxy]ethyl]-2,4,8,10-tetraoxaspiro[5,5]-undecane (for example, Sumilizer GA-80, manufactured by Sumitomo Chemical Co., Ltd.), and 1,3,5-tris-[[4-(1,1-dimethylethyl)-3-hydroxy-2,6-dimethyl phenyl] methyl]-1,3,5-triazine-2,4,6(1H,3H,5H)-trione (for example, THANOX 1790, manufactured by Tokyo Chemical Industry, and CYANOX1790, manufactured by CYTEC), because they serve effectively for the depression of oxidative decomposition.

A phosphorus based compound is a phosphorus based antioxidant that oxidizes itself while reducing a peroxide without generate radicals, and such compounds may be used singly or as a mixture of two or more thereof. In particular, tris(2,4-di-tert-butylphenyl) phosphite (for example, Irgafos168, manufactured by BASF) and 3,9-bis(2,6-di-t-butyl-4-methylphenoxy)-2,4,8,10-tetraoxa-3,9-diphosphaspiro[5,5] undecane (for example, Adeka Stab PEP-36, manufactured by Adeka Corporation) can be adopted suitably because they serve effectively for the depression of oxidative decomposition.

A hindered amine based compound is a hindered amine based antioxidant that serves to capture radicals produced by ultraviolet ray, heat and the like, or regenerate a phenolic antioxidant in a deactivated state after functioning as an antioxidant, and such compounds may be used singly or as a mixture of two or more thereof. In particular, aminoether type hindered amine based compounds and high molecular weight type hindered amine based compounds with molecular weights of 1,000 or more can be adopted suitably. Specific examples of the aminoether type hindered amine based compounds include, but not limited to, bis(1-undecanoxy-2,2,6,6-tetramethylpiperidine-4-yl) carbonate (for example, Adeka Stab LA-81, manufactured by Adeka Corporation) and decanedioic acid bis[2,2,6,6-tetramethyl-1-(octyloxy) piperidine-4-yl] (for example, Tinuvin PA 123, BASF). The use of a high molecular weight type hindered amine based compound with a molecular weight of 1,000 or more is preferable because it serves to depress the elution from the interior of fiber during washing or cleaning with an organic solvent. Specific examples of the high molecular weight type hindered amine based compound with a molecular weight of 1,000 or more include, but not limited to, N—N'—N"—N'"-tetrakis (4,6-bis(butyl-(N-methyl-2,2,6,6-tetramethyl piperidine-4-yl) amino) triazine-2-yl)-4,7-diazadecane-1,10-diamine) (SABOSTAB UV119, manufactured by SABO), poly((6-((1,1,3,3-tetramethylbutyl)amino)-1,3,5-triazine-2,4-diyl) (2,2,6,6-tetramethyl-4-piperidinyl) imino)-1,6-hexane-diyl(2,2,6,6-tetramethyl-4-piperidinyl) imino)) (for example, CHIMASSORB 944, manufactured by BASF), and polycondensate of dibutylamine-1,3,5-triazine-N,N'-bis(2,2,6,6-tetramethyl-4-piperidyl)-1,6-hexamethylene diamine and N-(2,2,6,6-tetramethyl-4-piperidyl) butylamine (for example, CHIMASSORB 2020, manufactured by BASF).

For the false-twisted yarn of a dyeable polyolefin fiber, it is preferable that the antioxidants account for 0.1 to 5.0 parts by weight relative to the total quantity of the polyolefin (A), polyester (B), and compatibilizer (C), which accounts for 100 parts by weight. An antioxidant content of 0.1 parts by weight or more is preferable because it can impart oxidative decomposition controlling property to the fiber. It is more preferable for the antioxidant to account for 0.3 parts by weight or more, still more preferably 0.5 part by weight or more. On the other hand, an antioxidant content of 5.0 parts by weight or less is preferable because the fiber will not suffer from debasement in color tone or deterioration in mechanical properties. It is more preferable for the antioxidant to account for 4.0 parts by weight or less, still more preferably 3.0 parts by weight or less, and particularly preferably 2.0 parts by weight or less.

A spinning oil solution, false-twisting oil solution or the like may be added to the false-twisted yarn of a dyeable polyolefin fiber as required for specific purposes or uses. As constituents, these oil solutions preferably contain an aliphatic ester based compound, polyether based compound, or the like that serve as lubricating agents to enhance the process passing property. A nonionic based surface active agent is preferably used as an emulsifier for water and various components of oil solutions. Compared to polyester fibers and the like, polyolefin fibers are little hygroscopic and liable to frictional electrification. To enhance the process passing property, fatty acid salts (soap), phosphate based compounds, sulfonate based compounds, and the like can be preferably adopted as antistatic agent. For qualitative analysis of components of the oil solutions attached to the false-twisted yarn of a dyeable polyolefin fiber to be achieved from observation of the false-twisted yarn, a good procedure is to wash the false-twisted yarn with methanol, evaporate methanol from the methanol-containing liquid resulting from washing to provide concentrate, analyze it by infrared spectroscopy (IR), and compare authentic samples of the oil solutions or oil solution components with infrared absorption spectra.

The false-twisted yarn of a dyeable polyolefin fiber may be one that has been modified through various methods by adding minor additives. Specific examples of such minor additives include, but not limited to, phenolic antioxidant, phosphorus based antioxidant, hindered amine based antioxidant, plasticizer, ultraviolet absorber, infrared ray absorbent, fluorescent brightening agent, mold releasing agent, antibacterial agent, nuclear formation agent, thermal stabilizer, antistatic agent, color protection agent, adjustor, delustering agent, antifoam agent, antiseptic agent, gelatinizer, latex, filler, ink, coloring agent, dye, pigment, and perfume. These minor additives may be used singly, or two or more thereof may be used in combination.

Next, described below are fiber characteristics of the false-twisted yarn of a dyeable polyolefin fiber.

There are no specific limitations on the fineness of the false-twisted yarn of a dyeable polyolefin fiber, which therefore may be adjusted appropriately to suit particular uses and required characteristics, but it is preferably 10 to 500 dtex. The fineness is determined by the method described in the Examples. If the false-twisted yarn of a dyeable polyolefin fiber has a fineness of 10 dtex or more, it is preferable because it ensures low thread breakage frequency and good process passing property and the yarn will not suffer significant fuzzing while in service, leading to high durability. It is more preferable for the false-twisted yarn of a dyeable polyolefin fiber to have a fineness of 30 dtex or more, still more preferably 50 dtex or more. On the other hand, if the fineness of the false-twisted yarn of a dyeable polyolefin fiber is 500 dtex or less, it is preferable because the fiber and fibrous structures will not suffer a decrease in flexibility. It is more preferable for the false-twisted yarn of a dyeable polyolefin fiber to have a fineness of 300 dtex or less, still more preferably 150 dtex or less.

The false-twisted yarn of a dyeable polyolefin fiber may have an appropriately selected single fiber fineness to suit particular uses and required characteristics, but it is preferably 0.5 to 20 dtex. The single fiber fineness is calculated by dividing the fineness measured by the method described in the Examples by the number of single yarns. If the single fiber fineness of the false-twisted yarn of a dyeable polyolefin fiber is 0.5 dtex or more, it is preferable because it ensures low thread breakage frequency and good process passing property and the yarn will not suffer significant fuzzing while in service, leading to high durability. It is more preferable for the false-twisted yarn of a dyeable polyolefin fiber to have a single fiber fineness of 0.6 dtex or more, still more preferably 0.8 dtex or more. On the other hand, if the single fiber fineness of the false-twisted yarn of a dyeable polyolefin fiber is 20 dtex or less, it is preferable because the fiber and fibrous structures will not suffer a decrease in flexibility. It is more preferable for the false-twisted yarn of a dyeable polyolefin fiber to have a single fiber fineness of 10 dtex or less, still more preferably 6 dtex or less.

The false-twisted yarn of a dyeable polyolefin fiber may have an appropriately selected strength to suit particular uses and required characteristics, but it is preferably 1.0 to 6.0 cN/dtex from the viewpoint of mechanical characteristics. The strength is determined by the method described in the Examples. If the strength of the false-twisted yarn of a dyeable polyolefin fiber is 1.0 cN/dtex or more, it is preferable because the yarn will not suffer significant fuzzing while in service, leading to high durability. It is more preferable for the false-twisted yarn of a dyeable polyolefin fiber to have a strength of 1.5 cN/dtex or more, still more preferably 2.0 cN/dtex or more. On the other hand, for the false-twisted yarn of a dyeable polyolefin fiber, a higher strength is more desirable, but when produced stably through an industrial process, the false-twisted yarn of a dyeable polyolefin fiber normally has a strength of 6.0 cN/dtex.

The false-twisted yarn of a dyeable polyolefin fiber may have an appropriately selected elongation percentage to suit particular uses and required characteristics, but it is preferably 10% to 60% from the viewpoint of durability. The elongation percentage is determined by the method described in the Examples. If the elongation percentage of the false-twisted yarn of a dyeable polyolefin fiber is 10% or more, it is preferable because it allows the production of fiber and fibrous structures having high wear resistance, leading to depression of fuzzing while in service and high durability. It is more preferable for the false-twisted yarn of a dyeable polyolefin fiber to have an elongation percentage of 15% or more, still more preferably 20% or more. On the other hand, if the false-twisted yarn of a dyeable polyolefin fiber has an elongation percentage of 60% or less, it is preferable because it enables the production of fiber and fibrous structures with high dimensional stability. It is more preferable for the false-twisted yarn of a dyeable polyolefin fiber to have an elongation percentage of 55% or less, still more preferably 50% or less.

The false-twisted yarn of a dyeable polyolefin fiber has a fineness variation value U % (hi) of 0.1% to 1.5%. The fineness variation value U % (hi) is determined by the method described in the Examples. The fineness variation value U % (hi) is an indicator of the thickness unevenness in the fiber's length direction and a smaller fineness variation value U % (hi) means a smaller thickness unevenness in the fiber's length direction. The fineness variation value U % (hi) is preferably as small as possible from the viewpoint of process passing property and level dyeability, but the manufacturability-based lower limit is 0.1%. On the other hand, if the fineness variation value U % (hi) of the false-twisted yarn of a dyeable polyolefin fiber is 1.5% or less, it is preferable because it enables the production of a high level-dyeability fiber structure that is high in uniformity in the fiber's length direction, low in liability to fuzzing or thread breakage, and suitable to produce a dyed material with few defects such as dyeing unevenness and dyeing streaks. The fineness variation value U % (hi) of the false-twisted yarn of a dyeable polyolefin fiber is more preferably 1.2% or less, still more preferably 1.0% or less, and particularly preferably 0.9% or less.

The false-twisted yarn of a dyeable polyolefin fiber has preferably a specific gravity of 0.83 to 1.0. The specific gravity is determined by the method described in the Examples and it is the true specific gravity. In a hollow fiber, its apparent specific gravity is smaller than that of a fiber with the same true specific gravity, and the apparent specific gravity varies with the degree of hollowness. Polyolefin is generally low in specific gravity and, for an example, the specific gravities of polymethylpentene and polypropylene are 0.83 and 0.91, respectively. If polyolefin is processed into fiber, it will be possible to obtain a very lightweight fiber, but it has the disadvantage of being unable to be dyed. We combine a polyolefin having a small specific gravity and a dyeable copolyester to form a polymer alloy fiber, thereby imparting color developability to the low-weight polyolefin fiber. The specific gravity of the false-twisted yarn of a dyeable polyolefin fiber varies with the specific gravity of the polyester (B) to be combined with the polyolefin (A) to form a composite, the composite ratio between the polyolefin (A) and the polyester (B), or the like. The specific gravity of the false-twisted yarn of a dyeable polyolefin fiber is preferably as low as possible from the viewpoint of lightness, and it is preferably 1.0 or less. If the specific gravity of the false-twisted yarn of a dyeable polyolefin fiber is 1.0 or less, it is preferable because the lightness of the polyolefin (A) and the color developability of the polyester (B) can be maintained simultaneously. It is more preferable for the false-twisted yarn of a dyeable polyolefin fiber to have a specific gravity of 0.97 or less, more preferably 0.95 or less.

There are no specific limitations on the fiber's cross-sectional shape of the polyolefin fibers contained in the dyeable false-twisted yarn, and an appropriate one may be selected to suit particular uses and required characteristics.

It may be either a perfect circular cross section or a non-circular cross section. Specific examples of such non-circular shapes include, but not limited to, multilobar, polygonal, flattened, elliptic, C-shaped, H-shaped, S-shaped, T-shaped, W-shaped, X-shaped, Y-shaped, grid-like, double-crossed, and hollow.

As in other general fibers, the false-twisted yarn of our dyeable polyolefin fiber can be processed by, for example, twining, and can also be woven or knitted by methods generally used for general fibers.

Next, described below is the production method for the false-twisted yarn of a dyeable polyolefin fiber.

The generally known melt-spinning technique, drawing technique, or false-twisting technique can be used as a production technique for the false-twisted yarn of a dyeable polyolefin fiber.

Melt-spinning is performed first to prepare a undrawn yarn or a drawn yarn of a polymer alloy fiber, which is then processed by false-twisting to provide the false-twisted yarn of a dyeable polyolefin fiber.

To produce a polymer alloy fiber, useful methods of discharging the melt through a spinning nozzle to provide a fiber thread include, but not limited to, those described below. As a first example, the sea component and the island component are melt-kneaded in an extruder or the like to prepare composite chips, which are then dried as required, followed by supplying the chips to a melt-spinning machine, where they are melted, and weighing the melt by a metering pump. Subsequently, it is introduced into the spinning pack heated in the spin-block and the molten polymer is filtered in the spinning pack and then discharged through a spinning nozzle to provide a fiber thread. As a second example, chips are dried as required and the chips of the sea component and those of the island component are mixed together, followed by supplying the mixed chips to a melt-spinning machine, where they are melted, and weighing by a metering pump. Subsequently, it is introduced into the spinning pack heated in the spin-block and the molten polymer is filtered in the spinning pack and then discharged through a spinning nozzle to provide a fiber thread.

It is preferable that the polyolefin (A), polyester (B), and compatibilizer (C) are dried to a water content of 0.3 parts by weight or less before starting the melt-spinning step. A water content of 0.3 parts by weight or less is preferable because foam formation is prevented from being caused by water during the melt-spinning step, allowing the spinning to be performed stably. It is also preferable because it prevents the mechanical characteristics from declining due to hydrolysis and prevents the color tone from deteriorating. The water content is more preferably 0.2 parts by weight or less and still more preferably 0.1 parts by weight or less.

To allow the dispersed particle diameter of the island component to be in the suitable range, a good method is to maintain the melt viscosity ratio between the sea component polymer and the island component polymer of 0.1 to 10 at the spinning temperature. The melt viscosity ratio is calculated by the equation below from the melt viscosity A of the sea component and the melt viscosity B of the island component measured by the method described in the Examples.

Melt viscosity ratio=melt viscosity $A$ of sea component/melt viscosity $B$ of island component A small melt viscosity ratio is not preferable because not only the island component increases in dispersed particle diameter, but also formation of a polyolefin based fiber structure is impeded by the island component in the false-twisting step and it facilitates strain generation at the interface and tends to cause boundary separation, leading to a decline in the strength of false-twisted yarn and a decrease in the crimp recovery rate. Also in an excessively large melt viscosity ratio, the island component increases in dispersed particle diameter to cause deterioration in the yarn-making performance. Thus, the melt viscosity ratio is preferably 0.3 to 9 and more preferably 0.5 to 8.

As already described above, the crimp recovery rate (CR) can be increased by increasing the melt viscosity ratio. This prevents the island component polymer from acting to deteriorate the thermal setting performance of the polyolefin based false-twisted yarn. The hot-water dimensional change rate can be decreased by increasing the melt viscosity ratio. This prevents the island component polymer from acting to deteriorate the thermal setting performance of the polyolefin based false-twisted yarn, thereby leading to a decrease in the hot-water dimensional change rate.

When melt-spinning is performed to form a sea-island structure, a swell called Barus tends to form immediately below the spinneret to make the fiber's thinning deformation unstable, but the addition of a compatibilizer prevents the spinning performance from being deteriorated by the Barus. Furthermore, it also permits good thinning deformation of the fiber in the drawing and false-twisting steps. This results in a false-twisted yarn that is low in fineness irregularity and high in uniformity in the fiber's length direction and level dyeability.

The fiber yarn discharged from the spinneret is cooled and solidified in a cooling apparatus, taken up by a first godet roller, and wound up by a winder via a second godet roller to provide a wound yarn. A heating cylinder or heat insulation cylinder with a length of 2 to 20 cm may be installed below the spinneret as required to improve the spinning operability, productivity, and mechanical properties of the fiber. In addition, an oil feeding apparatus may be used to supply oil to the fiber yarn or an entangling machine may be used to entangle the fiber yarn.

The spinning temperature used for the melt-spinning may be set appropriately to suit the melting point and heat resistance of the polyolefin (A), polyester (B), and compatibilizer (C), but it is preferably 220° C. to 320° C. If the spinning temperature is 220° C. or more, it is preferable because the elongation viscosity of the fiber yarn discharged through the spinneret is maintained sufficiently low to ensure stable discharge and also because the spinning tension is prevented from increasing excessively to avoid yarn breakage. The spinning temperature is more preferably 230° C. or more and still more preferably 240° C. or more. On the other hand, if the spinning temperature is 320° C. or less, it is preferable because heat decomposition can be depressed during spinning to prevent the deterioration in mechanical properties and coloring of the false-twisted yarn of a dyeable polyolefin fiber. The spinning temperature is more preferably 300° C. or less and still more preferably 280° C. or less.

The spinning speed in the melt-spinning step may be set appropriately to suit the composite ratio and spinning temperature of the polyolefin (A) and polyester (B), but it is preferably 500 to 6,000 m/min. If the spinning speed is 500 m/min or more, it is preferable because the traveling of the yarn is maintained stable and yarn breakage is prevented. When a two-step process is adopted, the spinning speed is more preferably 1,000 m/min or more and still more preferably 1,500 m/min or more. On the other hand, if the spinning speed is 6,000 m/min or less, it is preferable because the spinning tension is controlled to prevent yarn breakage and ensure stable spinning. When a two-step process is adopted, the spinning speed is more preferably 4,500 m/min or less and still more preferably 4,000 m/min or less. For the spinning in a single step process in which spinning and drawing are performed simultaneously without winding up the yarn, it is preferable to use low speed rollers and high speed rollers that are 500 to 5,000 m/min and 2500 to 6,000 m/min, respectively. If the low speed rollers and high speed rollers are operated in the above range, it is preferable because the traveling yarn is maintained stable and yarn breakage is prevented to ensure stable spinning. For the spinning speed in the single step process, the low speed rollers and the high speed rollers are preferably 1,000 to 4,500 m/min and 3,500 to 5,500 m/min, respectively, and the low speed rollers and the high speed rollers are more preferably 1,500 to 4,000 m/min and 4,000 to 5,000 m/min, respectively.

When drawing is carried out in the single step process or the two step process, it may be performed by either a single stage drawing process or a multi-stage drawing process in which the yarn is drawn in two or more stages. There are no specific limitations on the heating method to use for the drawing as long as the traveling yarn can be heated directly or indirectly. Specific examples of heating methods include, but not limited to, the use of a heating roller, heating pin, heating plate, liquid bath such as warm water and hot water, gas bath such as hot air and steam, and laser. These heating methods may be used singly, or a plurality thereof may be used in combination. Favorable heating methods include contact with a heating roller, contact with a heating pin, contact with a heating plate, and immersion in a liquid bath from the viewpoint of control of the heating temperature, uniform heating of the traveling yarn, and simplification of equipment.

When drawing is carried out, the drawing temperature can be set up appropriately to suit the melting points of the polyolefin (A), polyester (B), and compatibilizer (C), strength and elongation percentage of drawn fiber, but it is preferably 20° C. to 150° C. If the drawing temperature is 20° C. or more, it is preferable because the yarn supplied to the drawing step is preheated sufficiently and uniform thermal deformation is achieved during the drawing step to avoid fuzzing and uneven fineness distribution, thereby making it possible to provide a fiber having high uniformity in the fiber's length direction and high level dyeability. The drawing temperature is more preferably 30° C. or more and still more preferably 40° C. or more. If the drawing temperature is 150° C. or less, on the other hand, it is preferable because fusion bonding among fibers and heat decomposition due to contact with the heating rollers can be prevented to ensure high process passing property and level dyeability. It is preferable also because the fiber can slip smoothly on the drawing rollers to ensure prevention of yarn breakage and stable drawing. The drawing temperature is more preferably 145° C. or less and still more preferably 140° C. or less. In addition, heat setting may be performed at 60° C. to 150° C. as required.

When drawing is carried out, the draw ratio may be set up appropriately depending on the elongation percentage of the undrawn fiber and the strength and elongation percentage of the drawn fiber, but it is preferably 1.02 to 7.0. If the draw ratio is 1.02 or more, it is preferable because such drawing can improve mechanical properties such as strength and elongation percentage of the fiber. The draw ratio is more preferably 1.2 or more and still more preferably 1.5 or more. On the other hand, if the draw ratio is 7.0 or less, it is preferable because yarn breakage during drawing is prevented to ensure stable drawing. The draw ratio is more preferably 6.0 or less and still more preferably 5.0 or less.

When drawing is carried out, the drawing speed can be set up appropriately taking into account, for example, whether the drawing method contains the single step process or the two step process. When the single step process is adopted, the speed of the high speed rollers used for spinning corresponds to the drawing speed. When the two step process is adopted for drawing, the drawing speed is preferably 30 to 1,000 m/min. If the drawing speed is 30 m/min or more, it is preferable because the traveling of the yarn is maintained stable and yarn breakage is prevented. When the two step process is adopted for drawing, the drawing speed is more preferably 50 m/min or more and still more preferably 100 m/min or more. On the other hand, if the drawing speed is 1,000 m/min or less, it is preferable because yarn breakage during drawing is prevented to ensure stable drawing. When the two step process is adopted for drawing, the drawing speed is more preferably 900 m/min or less and still more preferably 800 m/min or less.

The undrawn yarn or drawn yarn of the dyeable polyolefin fiber to be used for false-twisting may have an appropriately selected elongation percentage that suit particular uses and required characteristics, but it is preferably 30% to 200%. An elongation percentage of 30% or more allows the false-twisted yarn of a dyeable polyolefin fiber to be free of fuzzing and prevents generation of thread breakage in the false-twisting step, whereas an elongation percentage of 200% or less allows the false-twisting step to be performed stably. From such point of view, it is more preferable for the undrawn yarn or drawn yarn to have an elongation percentage of 35% to 150%, still more preferably 40% to 100%

Examples of the false-twisting equipment to be used for the false-twisting step include false-twisting apparatuses equipped with FR (feed rollers), 1DR (first draw roller), heater, cooling plate, false-twisting unit, 2DR (second draw roller), 3DR (third draw roller), entangling nozzle, 4DR (fourth draw roller), and winder.

The processing ratio between FR and 1DR may be appropriately set to suit the elongation percentage of the fiber to be used for processing and the elongation percentage of the false-twisted yarn of a dyeable polyolefin fiber, but it is preferably 1.0 to 2.0.

Either a contact type or a noncontact type heater may be used. An appropriate heater temperature may be adopted to suit the crimp recovery rate and hot-water dimensional change rate of the false-twisted yarn of a dyeable polyolefin fiber, but from the viewpoint of crimp recovery rate enhancement, it is preferably 90° C. or more, more preferably 100° C. or more, and still more preferably 110° C. or more in a contact type heater. In a noncontact type one, it is preferably 150° C. or more, more preferably 200° C. or more, and still more preferably 250° C. or more. The upper limit of the heater temperature may be appropriately set in a temperature rage where the undrawn yarn or drawn yarn to use does not undergo fusion bonding in the heater.

The false-twisting apparatus is preferably a friction false-twisting type one, and friction disk type and belt nip type ones are available. It is preferable to use a friction disk type apparatus, and in particular, the use of one equipped with a fully ceramic disk is preferable to ensure stable false-twisting if operated for a long period of time. The ratios between the 2DR and the 3DR and between the 3DR and the 4DR may be appropriately set to suit the crimp recovery rate and hot-water dimensional change rate of the false-twisted yarn of a dyeable polyolefin fiber, but normally, it is preferably 0.9 to 1.0. To improve the high order passing property of the false-twisted yarn, an entangling nozzle may be provided between the 3DR and the 4DR to perform entangling treatment or additional oil supply from an oil guide.

Dyeing either the fiber or the fiber structure may be performed as required. A disperse dye may be adopted favorably for the dyeing. The polyolefin (A) of the sea component in the false-twisted yarn of a dyeable polyolefin fiber can be little dyed, but the polyester (B) copolymerized with cyclohexanedicarboxylic acid of the island component is dyed, making it possible to provide a fiber or a fiber structure with vivid, deep color developability.

There are no specific limitations on the dyeing method, and generally known methods may be performed favorably using a cheese dyeing machine, jet dyeing machine, drum dyeing machine, beam dyeing machine, jigger dyeing machine, high pressure jigger dyeing machine and the like.

There are no specific limitations on the dye concentration and dyeing temperature, and generally known methods can be adopted favorably. In addition, refining may be performed as required before the dyeing step and reduction cleaning may be performed after the dyeing step.

The false-twisted yarn of a dyeable polyolefin fiber and the fiber structure thereof includes lightweight polyolefin fiber having vivid, deep color developability. Accordingly, they can be applied to apparel and other products that require lightness and color developability, in addition to those uses where conventional polyolefin fibers have been adopted. The uses where conventional polyolefin based fibers have been adopted include, but not limited to, interior uses such as tile carpets, household carpets, and automobile mats, bedding materials such as mattress wadding and pillow wadding, and general material uses such as ropes, protective nets, filter fabrics, narrow tapes, braids, and chair upholstery. In addition, there will be new uses to be developed including, but not limited to, general clothing such as women's wear, men's wear, lining, underwear, down jackets, vests, inner garments, and outer garments, sports clothing such as wind breakers, outdoor sports wear, skiing wear, golf wear, and swimsuits, bedding materials such as outer fabrics of mattress, mattress covers, blankets, outer fabrics of blankets, blanket covers, pillow covers, and sheets, interior materials such as tablecloth and curtains, and other materials such as belts, bags, sewing threads, sleeping bags, and tents.

EXAMPLES

Our fibers and methods are described in more detail below with reference to Examples. The characteristic values used in the Examples were determined by the following methods.

A. Melting Peak Temperature

A specimen was prepared from the polymer of the sea component (A) or the island component (B), and its melting peak temperature was measured using a differential scanning calorimeter (DSC) (Q2000, manufactured by TA Instruments). First, an approximately 5 mg portion of the specimen was heated from 0° C. to 280° C. in a nitrogen atmosphere at a heating rate of 50° C./min and maintained at 280° C. for 5 minutes to remove heat history from the specimen. Subsequently, it was quenched from 280° C. to 0° C. and heated again from 0° C. to 280° C. under the conditions including a heating rate of 3° C./min, a temperature modulation amplitude of ±1° C., and a temperature modulation period of 60 seconds to perform TMDSC measurement. The melting peak temperature was calculated from the melting peak observed in the second heating step according to JIS K 7121 (1987) (Measuring method for transition temperatures of plastics) 9.1. A total of three measurements were taken from a specimen, and their average was adopted as its melting peak temperature. When a plurality of melting peaks were observed, the melting peak temperature was calculated from the melting peak appearing at the lowest temperature.

B. Aromatic Ring Concentration

For the polymer of the sea component (A) or the island component (B), the aromatic ring concentration (mol/kg) was calculated by the equation below from the copolymerization rate (mol %) of the copolymerization components having aromatic rings and the molecular weight (g/mol) of the repeating units.

Aromatic ring concentration (mol/kg)=copolymerization rate (mol %) of copolymerization components having aromatic rings×10/molecular weight of repeating units (g/mol).

C. Refractive Index

The polymer of the sea component (A) or the island component (B) was vacuum-dried first and a 1 g specimen was taken and processed into a pressed film using a four column, single action lifting type pressing machine (15TON, manufactured by Gonno Hydraulic Manufacturing Co., Ltd.). The specimen and a spacer with a thickness of 50 μm sandwiched between films of infusible polyimide (KAPTON (registered trademark) 200H, manufactured by Du Pont-Toray Co., Ltd.) were placed in a pressing machine and melted at 230° C. for 2 minutes, pressed under a pressure of 2 MPa for 1 minute, quickly taken out of the pressing machine, and quenched in water at 20° C. to provide a pressed film with a thickness of 50 μm. Subsequently, the refractive index of the pressed film was determined according to the measuring method for film specimens specified in JIS K0062 (1992) (Measuring method for refractive index of chemical products) 6. In an environment at a temperature of 20° C. and a humidity of 65% RH, three measurements were taken from a specimen using an Abbe refractometer (ER-1, manufactured by Erma Inc.), monobromonaphthalene (nD=1.66) as intermediate liquid, and a test piece (nD=1.74) as glass plate, and their average was adopted as the refractive index.

The polymer of the sea component (A) in Example 29 and the polymer of the island component (B) in Comparative example 2 were melted at a temperature of 270° C., and the polymer of the island component (B) in Examples 8, 9, and 10 and Comparative examples 6 and 7 was melted at a temperature of 250° C. to prepare pressed films.

D. Composite Ratio

Relative to the total quantity of the sea component (A), island component (B), and compatibilizer (C) used as materials for the false-twisted yarn of a dyeable polyolefin fiber, which accounts for 100 parts by weight, the composite ratio of sea component (A)/island component (B)/compatibilizer (C) (parts by weight) was calculated.

E. Fineness

In an environment at a temperature of 20° C. and a humidity of 65% RH, a 100 m specimen taken from the false-twisted yarn prepared in each Example was wound into a hank using an electric sizing reel manufactured by INTEC. The weight of the resulting hank was measured and its fineness (dtex) was calculated by the equation below. Five measurements were taken from a specimen, and their average was taken as the fineness.

Fineness (dtex)=weight (g) of 100 m fiber×100

F. Strength and Elongation Percentage

The strength and elongation percentage of a specimen of the false-twisted yarn prepared in each Example were calculated according to JIS L 1013 (2010) (Test method for chemical fiber filament yarn) 8.5.1. In an environment at a temperature of 20° C. and a humidity of 65% RH, a tensile test was performed using Tensilon UTM-III-100, manufactured by Orientec Co., Ltd., under the conditions of an initial specimen length of 20 cm and tension speed of 20 cm/min. The strength (cN/dtex) was calculated by dividing the stress (cN) at the point showing the maximum load by the fineness (dtex) and the elongation percentage (%) was calculated by the equation below from the elongation (L1) at the point showing the maximum load and the initial specimen length (L0). Ten measurements were taken from a specimen, and the averages were adopted as the strength and elongation percentage.

$$\text{Elongation percentage (\%)}=\{(L1-L0)/L0\}\times 100$$

G. Fineness Variation Value U % (hi)

The fineness variation value (half inert) U % (hi) was measured from the false-twisted yarn specimen prepared in each Example using an Uster tester (4-CX, manufactured by Zellweger Uster) under the conditions of a measuring speed of 200 m/min, measuring time of 2.5 minutes, measuring fiber length of 500 m, and twisting frequency of 12,000/m (S-twist). Five measurements were taken from a specimen, and the average was adopted as the fineness variation value U % (hi).

H. Dispersed Particle Diameter of Island Component and Discontinuity of Island Component The false-twisted yarn specimen prepared in each Example was embedded in epoxy resin and cut together with the epoxy resin in the perpendicular direction to the fiber axis using an ultramicrotome (LKB-2088, manufactured by LKB) to provide an ultrathin section with a thickness of about 100 nm. The resulting ultrathin section was dyed by leaving it for about 4 hours in a vapor phase generated from solid ruthenium tetroxide at room temperature and then the dyed face was cut with an ultramicrotome to provide an ultrathin section dyed with ruthenium tetroxide. A cross section of the dyed ultrathin section perpendicular to the fiber axis, that is, a transverse cross section of the fiber, was observed using a transmission electron microscope (TEM) (H-7100FA, manufactured by Hitachi, Ltd.) under the conditions of an accelerating voltage of 100 kV to take a microphotograph of the fiber's transverse cross section. Observation was performed at magnifications of ×300, ×500, ×1,000, ×3,000, ×5,000, ×10,000, ×30,000, and ×50,000, and a microphotograph was taken at the lowest magnification where 100 or more island domains are seen. In regard to the photographs thus taken, the diameters of 100 island domains selected randomly from each photograph were determined using an image processing software tool (WINROOF, manufactured by Mitani Corporation), and the average of the measurements was adopted as the dispersed particle diameter (nm) of the island domains. The island domains present in the fiber cross section do not necessarily have a perfect circular shape, and in a domain of a non-perfect circular shape, the diameter of the circumscribed circle was adopted as the dispersed particle diameter of the island component.

When a sampled single yarn failed to have a fiber cross section containing 100 or more island domains, a plurality of single yarns produced under the same conditions were used as specimens for fiber cross section observation. When taking a microphotograph, photographing was performed at the highest magnification where the entire single yarn was observable. For the photographs thus taken, the dispersed particle diameters of the island domains present in the fiber cross section of each single yarn were measured and the average of a total of 100 measured dispersed particle diameters of island domains was adopted to represent the dispersed particle diameter of the island domains.

To examine the continuity of the island domains, five fiber cross sections of a single yarn were selected appropriately at intervals of at least 10,000 times or more of the diameter of the single yarn and photographed under a microscope. If the number of island domains and the shape of the sea-island structure differ among the fiber cross sections, the island domains were judged as discontinuous and the decision was shown as "Y" when the island domains were discontinuous or "N" when the island domains were not discontinuous.

I. Specific Gravity

The specific gravity of a specimen of the false-twisted yarn prepared in each Example was calculated according to the sink-float method specified in JIS L 1013 (2010) (Test method for chemical fiber filament yarn) 8.17. A specific gravity measuring liquid was prepared using water as heavy liquid and ethyl alcohol as light liquid. In a temperature controlled bath maintained at a temperature of 20±0.1° C., a specimen of about 0.1 g was left in the specific gravity measuring liquid for 30 minutes and then the sink-and-float state of the specimen was observed. Either the heavy liquid or the light liquid was added depending on the sink-and-float state and the specimen was left to stand for additional 30 minutes. After confirming that the specimen was in an equilibrium sink-and-float state, the specific gravity of the specific gravity measuring liquid was measured and then the specific gravity of the specimen was calculated. Five measurements were taken from a specimen, and the average was adopted to represent the specific gravity.

J. Crimp Recovery Rate (CR)

Crimp recovery rate (CR) evaluation was performed according to JIS L 1013 (2010) 6 (Sampling and preparation) and 8.12 (Crimp recovery rate). A 10-loop hank with a hank length of 40 cm was prepared under a load of 0.176 mN×fineness (dtex)×10, and then an initial load of 0.176 mN×20×fineness (dtex)×10 was applied to this hank while the polyolefin fiber was subjected to hot-water treatment in hot water at 70° C. (90° C. in polyester) for 20 minutes, followed by water removal with filter paper and natural drying for 12 hours or more. Subsequently, the hank maintained under the above initial load was immersed in water at 20° C. (at 18° C. to 22° C.), and left to stand for 2 minutes while applying an additional standard load of 8.82 mN×20×fineness (dtex)×10, followed by measuring the length of the hank, which is denoted as hank length a. Then, the standard load was removed in water, and it was left to stand for 2 minutes under the initial load alone. After the shelf time, the length of the hank, which is denoted as hank length b, was measured. Five measurements of the hank length a and hank length b were taken from different specimens and the crimp recovery rate (CR) was calculated by the equation below, followed by calculating the average to be adopted.

$$\text{Crimp recovery rate (CR) (\%)}=\{(\text{hank length } a-\text{hank length } b)/\text{hank length } a\}\times 100$$

K. Hot-Water Dimensional Change Rate

Hot-water dimensional change rate evaluation was performed according to JIS L 1013 (2010) 8.18.1 (Hot-water dimensional change rate: hank size change rate (Method A)). The false-twisted yarn was wound back using an electric sizing reel with a circumference of 1.0 m (manufactured by INTEC) at a speed 120 rounds/min under a load of 8.82 mN×fineness (dtex)×10. After preparing a 20-loop hank, the hank was placed under a load of 8.82 mN×fineness (dtex)×

10×20 and the length of the hank, which is denoted as initial length L1, was measured. After removing the load, it was subjected to heat treatment in a hot water at 90° C. for 30 minutes and then water was removed with filter paper, followed by natural drying for 8 hours or more in a horizontal state and measurement of the length of the hank, which is denoted as post-treatment length L2, under the load of 8.82 mN×fineness (dtex)×10×20. Ten measurements of the initial length L1 and post-treatment length L2 were taken from different specimens and the hot-water dimensional change rate was calculated by the equation below, followed by calculating the average to be adopted.

Hot-water dimensional change rate (%)={(initial length $L1$−post-treatment length $L2$)/initial length $L1$}×100

L. L* Value

The false-twisted yarn prepared in each Example was used as a specimen, and a circular knitted fabric of about 2 g was prepared using a circular knitting machine (NCR-BL, manufactured by Eiko Industrial Co., Ltd., diameter 3.5 inch (8.9 cm), 27-gauge) and refined at 80° C. for 20 minutes in an aqueous solution containing 1.5 g/L of sodium carbonate and 0.5 g/L of a surface active agent (Gran Up US-20, manufactured by Meisei Chemical Works, Ltd.), followed by rinsing with running water for 30 minutes and drying in a hot air drier at 60° C. for 60 minutes. The refined circular knitted fabric was dry-heat set at 135° C. for 1 minute and 1.3 parts by weight of Kayalon Polyester Blue UT-YA manufactured by Nippon Kayaku Co., Ltd. was added as disperse dye to the dry-heat-set circular knitted fabric specimen, followed by dyeing in a dyeing solution adjusted to pH 5.0 at 130° C. for 45 minutes at a bath ratio of 1:100. Then, it was rinsed with running water for 30 minutes and dried in a hot air drier at 60° C. for 60 minutes. The dyed circular knitted fabric was subjected to reduction cleaning at 80° C. for 20 minutes at a bath ratio of 1:100 in an aqueous solution containing 2 g/L of sodium hydroxide, 2 g/L of sodium dithionite, and 0.5 g/L of a surface active agent (Gran Up US-20, manufactured by Meisei Chemical Works, Ltd.), followed by rinsing with running water for 30 minutes and drying in a hot air drier at 60° C. for 60 minutes. The reduction-cleaned circular knitted fabric was subjected to dry-heat setting at 135° C. for 1 minute for finishing. The L* value of the finish-set circular knitted fabric specimen was measured using a spectrophotometer (CM-3700d, manufactured by Minolta) with a D65 light source and view angle of 10° under SCE (specular component excluded) optical conditions. Three measurements were taken from a specimen, and the average was adopted as L* value.

M. Color Fastness to Light

Evaluation for color fastness to light was carried out according to JIS L 0843 (2006) (Test method for color fastness to light of xenon arc lamp) Method A. Using a xenon weather meter (X25, manufactured by Suga Test Instruments Co., Ltd.), the finish-set circular knitted fabric specimen prepared in the above paragraph L was exposed to light from a xenon-arc lamp, and its light fastness was evaluated based on the degree of discoloration of the specimen determined with reference to a discoloration gray scale as specified in JIS L 0804 (2004).

N. Color Fastness to Washing

Evaluation for color fastness to washing was carried out according to JIS L 0844 (2011) (Test method for color fastness to washing) A-2. Using a Laundermeter tester manufactured by Daiei Kagaku Seiki Mfg. Co., Ltd., the finish-set circular knitted fabric specimen prepared in the above paragraph L was subjected to laundering treatment along with a piece of white cloth attached to the tester (cotton No. 3-1, nylon No. 7-1) as specified in JIS L 0803 (2011), and the degree of discoloration of the specimen was determined with reference to a discoloration gray scale as specified in JIS L 0804 (2004), thereby evaluating the color fastness to washing.

O. Color Fastness to Rubbing

Evaluation for color fastness to rubbing was carried out by the drying test according to the friction testing machine II type (Gakushin type) method specified in JIS L 0849 (2013) (Test method for color fastness to rubbing) 9.2. Using a Gakushin type rubbing tester (RT-200, manufactured by Daiei Kagaku Seiki Mfg. Co., Ltd.), the finish-set circular knitted fabric specimen prepared in the above paragraph L was rubbed with white cotton cloth (cotton No. 3-1) as specified in JIS L 0803 (2011), and its rubbing fastness was evaluated based on the degree of stain on the white cotton cloth determined with reference to a stain gray scale as specified in JIS L 0805 (2005).

P. Lightness

For the false-twisted yarn prepared in each Example, lightweight property was evaluated based on the specific gravity of the fiber determined in the above paragraph I and ranked according to a four level criterion for ratings of S, A, B, or C. To show the evaluation results, S represents the highest quality level, and A, B, and C represent lower, still lower, and the lowest quality levels, respectively. A specimen was ranked as S when the specific gravity of the fiber was less than 0.95, A when it was 0.95 or more and less than 1.0, B when it was 1.0 or more and less than 1.1, and C when it was 1.1 or more, and judged as acceptable when it was ranked as A (0.95 or more and less than 1.0) or higher.

Q. Color Developability

The color developability was evaluated based on the L* value determined in the above paragraph L and ranked according to a four level criterion for ratings of S, A, B, or C. A smaller L* value indicates a higher color developability. To show the evaluation results, S represents the highest quality level, and A, B, and C represent lower, still lower, and the lowest quality levels, respectively. A specimen was ranked as S when the L* value was less than 35, A when it was 35 or more and less than 40, B when it was 40 or more and less than 60, and C when it was 60 or more, and judged as acceptable when it was ranked as A (35 or more and less than 40) or higher.

R. Level Dyeability, Bulkiness, and Flexibility

The finish-set circular knitted fabric specimen prepared in the above paragraph L was evaluated according to a four level criterion for ratings of S, A, B, or C. The evaluation assumed its use as material for inner garments and a decision was made by mutual consent among five testers having five-year or longer experience in this kind of testing. To show the evaluation results, S represents the highest quality level, and A, B, and C represent lower, still lower, and the lowest quality levels, respectively.

Level dyeability: The specimen was evaluated according to the following criteria, and those ranked as S or A were judged as acceptable.

S: Dyed highly uniformly with no dyeing specks detected,

A: Dyed nearly uniformly with almost no dyeing specks detected,

B: Dyed little uniformly with slight dyeing specks detected, and

C: Not dyed uniformly with clear dyeing specks detected.

Bulkiness: The specimen was evaluated according to the following criteria, and those ranked as S or A were judged as acceptable.

S: The circular-knitted fabric is very thick and voluminous, showing a very high bulkiness.

A: The circular-knitted fabric is sufficiently thick and voluminous, showing a high bulkiness.

B: The circular-knitted fabric is not sufficiently thick or voluminous, showing a poor bulkiness.

C: The circular-knitted fabric is not thick or voluminous, showing a very poor bulkiness.

Flexibility: The specimen was evaluated according to the following criteria, and those ranked as S or A were judged as acceptable.

S: The circular-knitted fabric is very flexible when bent, showing a very high flexibility.

A: The circular-knitted fabric is sufficiently flexible when bent, showing a high flexibility.

B: The circular-knitted fabric is not sufficiently flexible when bent, showing a poor flexibility.

C: The circular-knitted fabric is not flexible when bent, showing a very poor flexibility.

S. Melt Viscosity

A 20 g specimen of the polymer was vacuum-dried to a water content of 0.1% or less and subjected to melt viscosity measurement by Capilograph manufactured by Toyo Seiki Seisaku-sho, Ltd. with a single hole nozzle with a hole length of 40 mm and a hole diameter of 1 mm under the conditions of a shear rate of 243.2/second. The cylinder temperature of Capilograph was adjusted to the same temperature as the spinning temperature (250° C. to 290° C.) adopted in Examples and the polymer was melted and retained in the nitrogen-filled cylinder for 5 minutes, followed by measuring the melt viscosity. Five melt viscosity measurements were taken from different specimens and the average was adopted. After separately measuring the melt viscosity A of the sea component polymer and the melt viscosity B of the island component polymer, the melt viscosity ratio between the sea component polymer and the island component polymer was calculated by the equation below.

Melt viscosity ratio=melt viscosity $A$ of sea component/melt viscosity $B$ of island component T. Maximum Temperature in Specimen in Oxidation Exotherm Test Test was carried out according to the oxidation exotherm test method (acceleration method) for polypropylene fibers established by the Japan Chemical Fibers Association. The false-twisted yarn prepared in each Example was used as a specimen, and a circular knitted fabric was prepared using a circular knitting machine (NCR-BL, manufactured by Eiko Industrial Co., Ltd., diameter 3.5 inch (8.9 cm), 27-gauge) and subjected to washing and tumbler drying as pretreatment. Washing was performed according to JIS L 0217 (1995) (Label signs and labeling method relating to handling of fiber products) No. 103 method using Attack (manufactured by Kao) as detergent and Haiter (2.3 ml/L) (manufactured by Kao) as bleaching agent. The specimen was washed 10 times and then dried in a tumbler drier at 60° C. for 30 minutes. A total of 10 rounds of pre-treatment, each consisting of washing 10 times and tumbler drying one, were carried out.

Circular pieces with a diameter of 50 mm were cut out from the pre-treated circular knitted fabric and put in a tubular container to fill it up to half the depth (25 mm), and then a thermocouple was inserted into the center of them, followed by filling the tubular container to the top without leaving gaps with addition pieces of the pre-treated circular knitted fabric. The tubular container used was 51 mm in inside diameter and 50 mm in depth and had 25 holes with a diameter of 5 mm in the lid and the bottom each and 140 holes with a diameter of 5 mm in the side wall.

The tubular container filled with pieces of the pre-treated circular knitted fabric was put in a constant temperature drier set to 150° C., and the changes in temperature were recorded for a 100-hour period starting at the time when the temperature indicated by the thermocouple installed at the center of the tubular container (corresponding to the specimen temperature) reached 150° C. to determine the maximum temperature in the specimen. Two measurements were taken from a specimen, and their average was adopted as the maximum temperature in the specimen under oxidation exotherm test.

Example 1

In a twin-screw extruder, 95.2 parts by weight of polypropylene (PP) (1352F, manufactured by Formosa Plastics Corporation, melting peak temperature 159° C., melt viscosity 1,030 poise), 4.8 parts by weight of polyethylene terephthalate copolymerized 30 mol % with 1,4-cyclohexanedicarboxylic acid, 0.05 parts by weight of 1,3,5-tris-[[4-(1,1-dimethylethyl)-3-hydroxy-2,6-dimethylphenyl] methyl]-1,3,5-triazine-2,4,6(1H,3H,5H)-trione, which is a phenolic compound (Cyanox1790, manufactured by CYTEC), as antioxidant, 0.05 parts by weight of tris-(2,4-di-t-butylphenyl) phosphite, which is a phosphorus based compound (Irgafos 168, manufactured by BASF), and 0.6 part by weight of bis(1-undecanoxy-2,2,6,6-tetramethylpiperidine-4-yl) carbonate, which is a hindered amine based compound (Adeka Stab LA-81, manufactured by Adeka Corporation) were fed and kneaded at a kneading temperature of 230° C. The strand discharged from the twin screw extruder was cooled in water and then cut by a pelletizer at intervals of about 5 mm to provide pellets. The pellets obtained were vacuum-dried at 95° C. for 12 hours and supplied to an extruder type melt-spinning machine in which they were melted and discharged through a spinneret (discharge hole size 0.23 mm, discharge hole length 0.30 mm, number of holes 36, round holes) at a discharge rate of 23.1 g/min and a spinning temperature of 250° C. to provide spun threads. These spun threads were cooled in a cooling air flow with an air temperature of 20° C. and flow speed of 25 m/min, collected while supplying oil from an oil feeder, taken up by a first godet roller rotating at 1,250 m/min, wound up by a winder via a second godet roller rotating at the same speed as the first godet roller to provide a 185 dtex-36 f undrawn yarn. The resulting undrawn yarn was drawn in two steps with a total draw ratio of 2.7 under the conditions of a first hot roller temperature of 30° C., second hot roller temperature of 30° C., and a third hot roller temperature of 130° C. to provide a 69 dtex-36 filament drawn yarn with a strength of 4.4 cN/dtex and an elongation percentage of 43%.

Using a drawing and false-twisting apparatus equipped with FR (feed rollers), 1DR (first draw roller), heater, cooling plate, false-twisting unit, 2DR (second draw roller), 3DR (third draw roller), entangling nozzle, 4 DR (fourth draw roller), and winder, the drawn yarn was subjected to false-twisting to provide a false-twisted yarn of a dyeable polyolefin fiber. The conditions for drawing and false-twisting were as described below.

A FR speed of 350 m/min, processing ratio of 1.05 between FR and 1DR, heating at 145° C. by heat-plate type contact heater (with a length of 110 mm), cooling plate with a length of 65 mm, friction disk type friction false-twisting apparatus, ratio of 1.0 between 2DR and 3DR, ratio of 0.98 between 3DR and 4DR, ratio of 0.94 between 4DR and winder, and entangling nozzle located between 3DR and 4DR to impart entanglement.

Table 1 shows evaluation results on the fiber characteristics and fabric characteristics of the resulting false-twisted yarn. The product names and quantities of the antioxidants are also given in Table 12. The resulting false-twisted yarn of a dyeable polyolefin fiber had a specific gravity of 0.93, showing a high lightness. It incorporates a sea region of a polypropylene with a small refractive index that contains finely dispersed island domains of polyethylene terephthalate copolymerized with cyclohexanedicarboxylic acid as a component with a small index and a high color developability to realize vivid, deep color development, resulting in an acceptable level of color developability. Furthermore, the yarn was high in dyeing fastness in terms of color fastness to light, color fastness to washing, and color fastness to rubbing, and it was possible to dye the entire fabric specimen uniformly, showing a high level dyeability. The measured crimp recovery rate of 30% and hot-water dimensional change rate of 3.5% show that the yarn is also high in bulkiness and flexibility, resulting in a fabric with smooth feel and good texture. In addition, the maximum specimen temperature in the oxidation exotherm test was 150° C., indicating that the oxidation exotherm was depressed.

Examples 2 to 7

Except for using polyesters (B) varying in melt viscosity, the same procedure as in Example 1 was carried out to produce false-twisted yarns. Tables 1 and 2 show fiber characteristics and evaluation results of the resulting false-twisted yarns.

Comparative Example 1

The drawn yarn obtained in Example 1 was evaluated for fiber characteristics and fabric characteristics without subjecting it to false-twisting. For Comparative example 1, the fiber characteristics and fabric characteristics given in Table 2 correspond to the evaluation results of the drawn yarn.

Fiber characteristics and evaluation results of the resulting drawn yarn are given in Table 2. The yarn was found to be high in dyeing fastness, lightness, color developability, and level dyeability, but it was not high enough in bulkiness because it was not false-twisted. It had an excessively slick touch and failed to have a pleasantly smooth touch such as realized in fabrics produced from false-twisted yarns.

Examples 8 to 14

Except that the copolymerization rate of cyclohexanedicarboxylic acid was as given in Tables 3 and 4, the same procedure as in Example 1 was carried out to prepare false-twisted yarns.

Evaluation results of the fiber characteristics and fabric characteristics of the false-twisted yarn obtained are given in Tables 3 and 4.

Comparative Example 2

Except for adopting a composite ratio of 95.2 parts by weight of polypropylene (PP) as the sea component and 4.8 parts by weight of polyethylene terephthalate (PET) (T701T, manufactured by Toray Industries, Inc., melting peak temperature 257° C.) as the island component and processing it at a kneading temperature of 280° C. and a spinning temperature of 285° C., the same procedure as in Example 1 was carried out to prepare a false-twisted yarn.

Evaluation results for fiber characteristics and fabric characteristics of the false-twisted yarn obtained are given in Table 4. Although the polyethylene terephthalate of the island component was found to be dyed with the dye, the polyethylene terephthalate was so high in crystallinity that the dye was not exhausted sufficiently and vivid, deep color development was not realized, resulting in an unacceptable level of color developability. In addition, the fineness variation value U % (hi) was too high and the uniformity in the fiber length direction was not sufficiently high, resulting in an inferior level of level dyeability.

Comparative Example 3

Except for using 100 parts by weight of polypropylene and omitting the use of polyethylene terephthalate copolymerized with 1,4-cyclohexanedicarboxylic acid, the same procedure as in Example 1 was carried out to prepare a false-twisted yarn.

Evaluation results for fiber characteristics and fabric characteristics of the false-twisted yarn obtained are given in Table 5. Polypropylene was little dyed with the disperse dye and accordingly, the false-twisted yarn obtained in Comparative example 3 was very low in color developability.

Examples 15 to 20 and Comparative Example 4

Except for adopting composite ratios between polypropylene and polyethylene terephthalate copolymerized with cyclohexanedicarboxylic acid as given in Tables 5 and 6, the same procedure as in Example 1 was carried out to prepare false-twisted yarns.

Evaluation results of the fiber characteristics and fabric characteristics of the false-twisted yarn obtained are given in Tables 5 and 6. In Comparative example 4, the composite ratio of the polyethylene terephthalate copolymerized with cyclohexanedicarboxylic acid was so high that the polyethylene terephthalate copolymerized with cyclohexanedicarboxylic acid formed sea regions whereas the polypropylene formed island domains, resulting in a high specific gravity and inferior lightness. Furthermore, although the color developability was high, the polypropylene of the island component was little dyed, resulting in an insufficient level of level dyeability. In addition, since the sea component was polyethylene terephthalate copolymerized with cyclohexanedicarboxylic acid, the fiber could not be heat-set easily. The crimp recovery rate was low and the hot-water dimensional change rate was high, resulting in an inferior level of bulkiness and flexibility.

Examples 21 to 29

Except for using, as compatibilizer, maleic anhydride modified polypropylene (POLYBOND 3200, manufactured by Addivant) in Example 21, maleic anhydride modified styrene-ethylene-butylene-styrene copolymer (Tuftec M1913, manufactured by Asahi Kasei Chemicals Corporation) in Example 22, and amine modified styrene-ethylene-butylene-styrene copolymer (Dynalon 8660P, manufactured by JSR Corporation) in Example 23, and adopting composite ratios among polypropylene, polyethylene terephthalate copolymerized with cyclohexanedicarboxylic acid, and compatibilizer as given in Tables 7, 8, and 9 in Examples 24 to 29, the same procedure as in Example 1 was carried out to prepare false-twisted yarns. Evaluation results of the fiber characteristics and fabric characteristics of the false-twisted yarns obtained are given in Tables 7, 8, and 9.

Example 30

In a twin screw extruder, 95.2 parts by weight of polymethylpentene (PMP) (DX820, manufactured by Mitsui Chemicals, Inc., melting peak temperature 232° C., melt viscosity 1010 poise) and 4.8 parts by weight of polyethylene terephthalate copolymerized 30 mol % with 1,4-cyclohexanedicarboxylic acid were fed and kneaded at a kneading temperature of 260° C. The strand discharged from the twin screw extruder was cooled in water and then cut by a pelletizer at intervals of about 5 mm to provide pellets. The pellets obtained were vacuum-dried at 95° C. for 12 hours and supplied to an extruder type melt-spinning machine in which they were melted and discharged through a spinneret (discharge hole size 0.23 mm, discharge hole length 0.30 mm, number of holes 36, round holes) at a discharge rate of 20.6 g/min and a spinning temperature of 290° C. to provide a spun yarn. The spun filaments were cooled in a cooling air flow at an air temperature of 20° C. and flow speed of 20 m/min, collected while supplying a lubricant from an oil feeder, taken up by a first godet roller rotating at 3,000 m/min, wound up by a winder via a second godet roller rotating at the same speed as the first godet roller to provide a 69 dtex-36 filament undrawn yarn with a strength of 2.0 cN/dtex and an elongation percentage of 43%.

Using a drawing and false-twisting apparatus equipped with FR (feed rollers), 1DR (first draw roller), heater, cooling plate, false-twisting unit, 2DR (second draw roller), 3DR (third draw roller), entangling nozzle, 4 DR (fourth draw roller), and winder, the undrawn yarn was subjected to false-twisting to provide a false-twisted yarn of a dyeable polyolefin fiber. The conditions for drawing and false-twisting were as described below.

A FR speed of 300 m/min, processing ratio of 1.05 between FR and 1DR, heating at 180° C. by heat-plate type contact heater (with a length of 110 mm), cooling plate with a length of 65 mm, friction disk type friction false-twisting apparatus, ratio of 1.0 between 2DR and 3DR, ratio of 0.98 between 3DR and 4DR, ratio of 0.98 between 4DR and winder, and entangling nozzle located between 3DR and 4DR to impart entanglement. Evaluation results for fiber characteristics and fabric characteristics of the false-twisted yarn obtained are given in Table 9.

Comparative Example 5

Except that polypropylene, polyethylene terephthalate copolymerized 31 mol % with cyclohexanedimethanol, and maleic anhydride modified polypropylene (POLYBOND 3200, manufactured by Addivant) were used on the basis of Example 1 described in Published Japanese Translation of PCT International Publication JP 2008-533315 and that the composite ratio was adjusted to 95.0/4.8/0.2, the same procedure as in Example 1 was carried out to produce a false-twisted yarn. A major difference from Example 1 is that polyethylene terephthalate copolymerized 31 mol % with cyclohexanedimethanol was used instead of polyethylene terephthalate copolymerized with cyclohexanedicarboxylic acid.

Evaluation results for fiber characteristics and fabric characteristics of the false-twisted yarn obtained are given in Table 10. Although the yarn had an acceptable level of bulkiness, flexibility, and level dyeability, the absence of polyethylene terephthalate copolymerized with cyclohexanedicarboxylic acid led to island domains with a high refractive index, resulting in an unacceptable level of color developability.

Comparative Example 6

Except that polyethylene terephthalate copolymerized 20 mol % with isophthalic acid and 20 mol % with cyclohexanedimethanol were used instead of polyethylene terephthalate copolymerized 31 mol % with cyclohexanedimethanol on the basis of Example 1 described in Published Japanese Translation of PCT International Publication JP 2001-522947, the same procedure as in Comparative example 5 was carried out to produce false-twisted yarn. A major difference from Example 1 is that polyethylene terephthalate copolymerized 20 mol % with isophthalic acid and 20 mol % with cyclohexanedimethanol were used instead of polyethylene terephthalate copolymerized with cyclohexanedicarboxylic acid.

Evaluation results for fiber characteristics and fabric characteristics of the false-twisted yarn obtained are given in Table 10. Although the yarn had an acceptable level of bulkiness, flexibility, and level dyeability, the absence of polyethylene terephthalate copolymerized with cyclohexanedicarboxylic acid led to island domains with a high refractive index, resulting in an unacceptable level of color developability.

Comparative Example 7

To prepare a sea component, polypropylene was kneaded with 0.05 parts by weight of 1,3,5-tris-[[4-(1,1-dimethylethyl)-3-hydroxy-2,6-dimethylphenyl]methyl]-1,3,5-triazine-2,4,6(1H,3H,5H)-trione, which is a phenolic compound (Cyanox1790, manufactured by CYTEC), 0.05 parts by weight of tris-(2,4-di-t-butylphenyl) phosphite, which is a phosphorus based compound (Irgafos168, manufactured by BASF), and 0.6 parts by weight of bis(1-undecanoxy-2,2,6,6-tetramethylpiperidine-4-yl) carbonate, which is a hindered amine based compound (Adeka Stab LA-81, manufactured by Adeka Corporation), which were added as antioxidants, whereas polyethylene terephthalate copolymerized with cyclohexanedicarboxylic acid was adopted as island component, and they were supplied to a pressure melter type conjugate spinning machine, in which they were melted separately, followed by discharging through a sea-island composite type spinneret (discharge hole size 0.18 mm, discharge hole length 0.23 mm, number of islands 32, number of holes 36, round holes) with a sea-island composite ratio as given in Table 11. Except for this, the same procedure as in Example 1 was carried out to produce a false-twisted yarn.

Evaluation results for fiber characteristics and fabric characteristics of the false-twisted yarn obtained are given in Table 11. The yarn had an acceptable level of bulkiness and flexibility, but, although the polyethylene terephthalate copolymerized with cyclohexanedicarboxylic acid of the island component was found dyed, the polypropylene of the sea component that covered the fiber surface layer was dyed so scarcely that vivid, deep color development was not realized, resulting in an unacceptable level of color developability. In addition, the fabric was not dyed uniformly as a whole, indicating that the level dyeability was also very low.

Comparative Examples 8 and 9

Polypropylene was kneaded with 0.05 parts by weight of 1,3,5-tris-[[4-(1,1-dimethylethyl)-3-hydroxy-2,6-dimethylphenyl]methyl]-1,3,5-triazine-2,4,6(1H,3H,5H)-trione, which is a phenolic compound (Cyanox1790, manufactured by CYTEC), 0.05 parts by weight of tris-(2,4-di-t-butylphenyl) phosphite, which is a phosphorus based compound (Irgafos 168, manufactured by BASF), and 0.6 parts by weight of bis(1-undecanoxy-2,2,6,6-tetramethylpiperidine-4-yl) carbonate, which is a hindered amine based compound (Adeka Stab LA-81, manufactured by Adeka Corporation), which were used as antioxidants, and fed, together with polyethylene terephthalate copolymerized with cyclohexanedicarboxylic acid, to a pressure melter type conjugate spinning machine, in which they were melted separately, followed by discharging through a core-sheath composite type spinneret (discharge hole size 0.18 mm, discharge hole length 0.23 mm, number of holes 36, round holes) with a sheath-core composite ratio as given in Table 11. Except for this, the same procedure as in Example 1 was carried out to produce a false-twisted yarn. It should be noted that the sea component corresponds to the sheath component whereas the island component corresponds to the core component in Comparative examples 8 to 9.

Evaluation results for fiber characteristics and fabric characteristics of the false-twisted yarn obtained are given in Table 11. In Comparative example 8, the yarn had an acceptable level of lightness, bulkiness and flexibility, but, although the polyethylene terephthalate copolymerized with cyclohexanedicarboxylic acid of the core component was found dyed, the polypropylene of the sheath component that covered the fiber surface layer was dyed so scarcely that vivid, deep color development was not realized, resulting in a very low level of color developability. In addition, the fabric was not dyed uniformly as a whole, indicating that the level dyeability was also very low. In Comparative example 9, the yarn had an acceptable level of flexibility, but, although the polyethylene terephthalate copolymerized with cyclohexanedicarboxylic acid of the sheath component that covered the fiber surface layer was found dyed, the polypropylene of the core component was dyed so scarcely that vivid, deep color development was not realized, resulting in a very low level of color developability. In addition, the polyethylene terephthalate copolymerized with cyclohexanedicarboxylic acid of the sheath component was removed partly during the false-twisting step, and as a result the fabric was not dyed uniformly as a whole, indicating that the level dyeability was also very low.

Examples 31 to 38

Except for adopting antioxidants of the types and quantities given in Tables 12 and 13, the same procedure as in Example 1 was carried out to produce a false-twisted yarn. Details are as described below.

In Example 31, except for adopting pentaerythritol-tetrakis (3-(3,5-di-t-butyl-4-hydroxyphenol) propionate) (Irganox 1010, manufactured by BASF) as phenolic compound type antioxidant, the same procedure as in Example 1 was carried out to produce a false-twisted yarn.

In Example 32, except for adopting 3,9-bis[1,1-dimethyl-2-[β-(3-t-butyl-4-hydroxy-5-methylphenyl) propionyloxy] ethyl]-2,4,8,10-tetraoxaspiro[5,5]-undecane (Sumilizer GA-80, manufactured by Sumitomo Chemical Co., Ltd.) as phenolic compound type antioxidant, the same procedure as in Example 1 was carried out to produce a false-twisted yarn.

In Example 33, except for adopting 3,9-bis(2,6-di-t-butyl-4-methyl phenoxy)-2,4,8,10-tetraoxa-3,9-diphosphaspiro5,5]undecane (Adeka Stab PEP-36, manufactured by Adeka Corporation) as phosphorous compound type antioxidant, the same procedure as in Example 1 was carried out to produce a false-twisted yarn.

In Example 34, except for adopting N—N'—N"—N'"-tetrakis (4,6-bis(butyl-(N-methyl-2,2,6,6-tetramethylpiperidine-4-yl) amino) triazine-2-yl)-4,7-diazadecane-1,10-diamine) (SABOSTAB UV119, manufactured by SABO) as hindered amine based compound type antioxidant, the same procedure as in Example 1 was carried out to produce a false-twisted yarn.

In Example 35, except for adopting the condensation polymer of dibutylamine-1,3,5-triazine-N,N'-bis(2,2,6,6-tetramethyl-4-piperidyl-1,6-hexamethylene diamine and N-(2,2,6,6-tetramethyl-4-piperidyl) butylamine (Chimassorb 2020, manufactured by BASF) as hindered amine based compound type antioxidant, the same procedure as in Example 1 was carried out to produce a false-twisted yarn.

In Example 36, except for adopting decanedioic acid bis[2,2,6,6-tetramethyl-1-(octyloxy) piperidine-4-yl] (Tinuvin PA123, manufactured by BASF) as hindered amine based compound type antioxidant, the same procedure as in Example 1 was carried out to produce a false-twisted yarn.

In Example 37, except for adopting an ester of 4-hydroxy-2,2,6,6-tetramethyl-1-piperidine ethanol and 3,5,5-trimethyl hexanoic acid (for example, Tinuvin 249, manufactured by BASF) as hindered amine based compound type antioxidant, the same procedure as in Example 1 was carried out to produce a false-twisted yarn.

In Example 38, except for adding no antioxidants, the same procedure as in Example 1 was carried out to produce a false-twisted yarn.

Evaluation results of the fiber characteristics and fabric characteristics of the false-twisted yarn obtained are given in Tables 14 and 15. In Example 38, the nonuse of an antioxidant results in a very high maximum specimen temperature of 167° C. in the oxidation exotherm test (Table 13).

Examples 39 to 45 and Comparative Example 10

Except for adopting various spinnerets and discharge rates, the same procedure as in Example 1 was carried out to produce false-twisted yarns differing in the number of filaments and fineness.

Evaluation results of the fiber characteristics and fabric characteristics of the false-twisted yarn obtained are given in Tables 16 and 17. In Comparative example 10, the number of filaments was as small as 2, resulting in a small crimp recovery rate (CR) and poor bulkiness.

TABLE 1

| | | | Example 1 | Example 2 | Example 3 | Example 4 |
|---|---|---|---|---|---|---|
| Spinning temperature and melt viscosity measuring temperature [° C.] | | | 250 | 250 | 250 | 250 |
| Sea/island composite conditions | sea component (A) | type of polymer | PP | PP | PP | PP |
| | | melting peak temperature [° C.] | 159 | 159 | 159 | 159 |
| | | aromatic ring concentration [mol/kg] | 0.00 | 0.00 | 0.00 | 0.00 |
| | | refractive index | 1.483 | 1.483 | 1.483 | 1.483 |
| | | melt viscosity [poise] | 1030 | 1030 | 1030 | 1030 |
| | island component (B) | type of polymer | copolymerized PET | copolymerized PET | copolymerized PET | copolymerized PET |
| | | CHDC copolymerization rate [mol %] | 30 | 30 | 30 | 30 |
| | | melting peak temperature [° C.] | N.D. | N.D. | N.D. | N.D. |
| | | aromatic ring concentration [mol/kg] | 3.61 | 3.61 | 3.61 | 3.61 |
| | | refractive index | 1.556 | 1.556 | 1.556 | 1.556 |
| | | melt viscosity [poise] | 335 | 2980 | 1480 | 1010 |
| | compatibilizer (C) | functional group | — | — | — | — |
| | | backbone chain | — | — | — | — |
| | melt viscosity ratio [—] | | 3.1 | 0.3 | 0.7 | 1.0 |
| | composite ratio | A/B/C [parts by weight] | 95.2/4.8/0.0 | 95.2/4.8/0.0 | 95.2/4.8/0.0 | 95.2/4.8/0.0 |
| | sea-island structure formation method | | alloy based | alloy based | alloy based | alloy based |
| Fiber characteristics of dyeable polyolefin false-twisted yarn | fineness [dtex] | | 66 | 66 | 66 | 66 |
| | number of filaments | | 36 | 36 | 36 | 36 |
| | strength [cN/dtex] | | 5.0 | 2.6 | 4.2 | 4.8 |
| | elongation percentage [%] | | 32 | 31 | 32 | 33 |
| | fineness variation value U % (hi) [%] | | 0.7 | 1.0 | 0.8 | 0.7 |
| | dispersed particle diameter of island component [nm] | | 240 | 680 | 460 | 360 |
| | discontinuity of island component | | Y | Y | Y | Y |
| | specific gravity | | 0.93 | 0.93 | 0.93 | 0.93 |
| | crimp recovery rate (CR) [%] | | 30 | 12 | 17 | 25 |
| | hot-water dimensional change rate [%] | | 3.5 | 6.4 | 5.3 | 4.0 |
| Fabric characteristics of dyeable polyolefin false-twisted yarn | L* value | | 32 | 36 | 34 | 33 |
| | color fastness to light [class] | | 4-5 | 4 | 4 | 4-5 |
| | color fastness to washing [class] | | 4-5 | 4 | 4 | 4-5 |
| | color fastness to rubbing [class] | | 4 | 3-4 | 4 | 4 |
| | lightness | | S | S | S | S |
| | color developability | | S | A | S | S |
| | level dyeability | | S | A | A | S |
| | bulkiness | | S | A | A | S |
| | flexibility | | S | A | A | S |
| | maximum specimen temperature in oxidation exotherm test [° C.] | | 150 | 150 | 150 | 150 |

PP: polypropylene,
PET: polyethylene terephthalate,
CHDC: cyclohexanedicarboxylic acid,
N.D.: not detected

TABLE 2

| | | | Example 5 | Example 6 | Example 7 | Comparative example 1 |
|---|---|---|---|---|---|---|
| Spinning temperature and melt viscosity measuring temperature [° C.] | | | 250 | 250 | 250 | 250 |
| Sea/island composite conditions | sea component (A) | type of polymer | PP | PP | PP | PP |
| | | melting peak temperature [° C.] | 159 | 159 | 159 | 159 |
| | | aromatic ring concentration [mol/kg] | 0.00 | 0.00 | 0.00 | 0.00 |
| | | refractive index | 1.483 | 1.483 | 1.483 | 1.483 |
| | | melt viscosity [poise] | 1030 | 1030 | 1030 | 1030 |
| | island component (B) | type of polymer | copolymerized PET | copolymerized PET | copolymerized PET | copolymerized PET |
| | | CHDC copolymerization rate [mol %] | 30 | 30 | 30 | 30 |
| | | melting peak temperature [° C.] | N.D. | N.D. | N.D. | N.D. |

TABLE 2-continued

| | | | Example 5 | Example 6 | Example 7 | Comparative example 1 |
|---|---|---|---|---|---|---|
| | | aromatic ring concentration [mol/kg] | 3.61 | 3.61 | 3.61 | 3.61 |
| | | refractive index | 1.556 | 1.556 | 1.556 | 1.556 |
| | | melt viscosity [poise] | 510 | 193 | 152 | 335 |
| | compatibilizer (C) | functional group | — | — | — | — |
| | | backbone chain | — | — | — | — |
| | melt viscosity ratio [—] | | 2.0 | 5.3 | 6.8 | 3.1 |
| | composite ratio A/B/C [parts by weight] | | 95.2/4.8/0.0 | 95.2/4.8/0.0 | 95.2/4.8/0.0 | 95.2/4.8/0.0 |
| | sea-island structure formation method | | alloy based | alloy based | alloy based | alloy based |
| Fiber characteristics of dyeable polyolefin false-twisted yarn | fineness [dtex] | | 66 | 66 | 66 | 66 |
| | number of filaments | | 36 | 36 | 36 | 36 |
| | strength [cN/dtex] | | 4.9 | 5.1 | 5.0 | 4.4 |
| | elongation percentage [%] | | 32 | 31 | 32 | 43 |
| | fineness variation value U % (hi) [%] | | 0.7 | 0.8 | 1.0 | 0.6 |
| | dispersed particle diameter of island component [nm] | | 280 | 260 | 280 | 245 |
| | discontinuity of island component | | Y | Y | Y | Y |
| | specific gravity | | 0.93 | 0.93 | 0.93 | 0.93 |
| | crimp recovery rate (CR) [%] | | 28 | 33 | 35 | 0 |
| | hot-water dimensional change rate [%] | | 3.8 | 2.9 | 2.5 | 3.8 |
| Fabric characteristics of dyeable polyolefin false-twisted yarn | L* value | | 32 | 32 | 31 | 31 |
| | color fastness to light [class] | | 4-5 | 4-5 | 4 | 4-5 |
| | color fastness to washing [class] | | 4-5 | 4-5 | 4 | 4-5 |
| | color fastness to rubbing [class] | | 4 | 4 | 4 | 4 |
| | lightness | | S | S | S | S |
| | color developability | | S | S | S | S |
| | level dyeability | | S | S | S | S |
| | bulkiness | | S | S | S | C |
| | flexibility | | S | S | S | S |
| | maximum specimen temperature in oxidation exotherm test [° C.] | | 150 | 150 | 150 | 150 |

PP: polypropylene,
PET: polyethylene terephthalate,
CHDC: cyclohexanedicarboxylic acid,
N.D.: not detected

TABLE 3

| | | | Example 8 | Example 9 | Example 10 | Example 11 |
|---|---|---|---|---|---|---|
| Spinning temperature and melt viscosity measuring temperature [° C.] | | | 250 | 250 | 250 | 250 |
| Sea/island composite conditions | sea component (A) | type of polymer | PP | PP | PP | PP |
| | | melting peak temperature [° C.] | 159 | 159 | 159 | 159 |
| | | aromatic ring concentration [mol/kg] | 0.00 | 0.00 | 0.00 | 0.00 |
| | | refractive index | 1.483 | 1.483 | 1.483 | 1.483 |
| | | melt viscosity [poise] | 1030 | 1030 | 1030 | 1030 |
| | island component (B) | type of polymer | copolymerized PET | copolymerized PET | copolymerized PET | copolymerized PET |
| | | CHDC copolymerization rate [mol %] | 10 | 15 | 20 | 40 |
| | | melting peak temperature [° C.] | 227 | 214 | 199 | N.D. |
| | | aromatic ring concentration [mol/kg] | 4.67 | 4.42 | 4.16 | 3.12 |
| | | refractive index | 1.569 | 1.566 | 1.562 | 1.548 |
| | | melt viscosity [poise] | 520 | 460 | 412 | 353 |
| | compatibilizer (C) | functional group | — | — | — | — |
| | | backbone chain | — | — | — | — |
| | melt viscosity ratio [—] | | 2.0 | 2.2 | 2.5 | 2.9 |
| | composite ratio A/B/C [parts by weight] | | 95.2/4.8/0.0 | 95.2/4.8/0.0 | 95.2/4.8/0.0 | 95.2/4.8/0.0 |
| | sea-island structure formation method | | alloy based | alloy based | alloy based | alloy based |
| Fiber characteristics of dyeable polyolefin false-twisted yarn | fineness [dtex] | | 66 | 66 | 66 | 66 |
| | number of filaments | | 36 | 36 | 36 | 36 |
| | strength [cN/dtex] | | 4.9 | 4.9 | 4.8 | 4.8 |
| | elongation percentage [%] | | 33 | 32 | 32 | 32 |
| | fineness variation value U % (hi) [%] | | 0.8 | 0.7 | 0.7 | 1.0 |
| | dispersed particle diameter of island component [nm] | | 340 | 300 | 280 | 250 |

TABLE 3-continued

| | | Example 8 | Example 9 | Example 10 | Example 11 |
|---|---|---|---|---|---|
| | discontinuity of island component | Y | Y | Y | Y |
| | specific gravity | 0.93 | 0.93 | 0.93 | 0.93 |
| | crimp recovery rate (CR) [%] | 25 | 26 | 28 | 31 |
| | hot-water dimensional change rate [%] | 4.0 | 3.8 | 3.7 | 3.2 |
| Fabric | L* value | 38 | 36 | 34 | 31 |
| characteristics | color fastness to light [class] | 4-5 | 4-5 | 4-5 | 4-5 |
| of dyeable | color fastness to washing [class] | 4-5 | 4-5 | 4-5 | 4-5 |
| polyolefin | color fastness to rubbing [class] | 4 | 4 | 4 | 4 |
| false-twisted | lightness | S | S | S | S |
| yarn | color developability | A | A | S | S |
| | level dyeability | S | S | S | S |
| | bulkiness | S | S | S | S |
| | flexibility | S | S | S | S |
| | maximum specimen temperature in oxidation exotherm test [° C.] | 150 | 150 | 150 | 150 |

PP: polypropylene,
PET: polyethylene terephthalate,
CHDC: cyclohexanedicarboxylic acid,
N.D.: not detected

TABLE 4

| | | | Example 12 | Example 13 | Example 14 | Comparative example 2 |
|---|---|---|---|---|---|---|
| Spinning temperature and melt viscosity measuring temperature [° C.] | | | 250 | 250 | 250 | 285 |
| Sea/island | sea | type of polymer | PP | PP | PP | PP |
| composite | component | melting peak | 159 | 159 | 159 | 159 |
| conditions | (A) | temperature [° C.] | | | | |
| | | aromatic ring concentration [mol/kg] | 0.00 | 0.00 | 0.00 | 0.00 |
| | | refractive index | 1.483 | 1.483 | 1.483 | 1.483 |
| | | melt viscosity [poise] | 1030 | 1030 | 1030 | 515 |
| | island | type of polymer | copolymerized | copolymerized | copolymerized | PET |
| | component | | PET | PET | PET | |
| | (B) | CHDC copolymerization rate [mol %] | 45 | 50 | 100 | 0 |
| | | melting peak temperature [° C.] | N.D. | N.D. | N.D. | 257 |
| | | aromatic ring concentration [mol/kg] | 2.86 | 2.56 | 0.00 | 5.20 |
| | | refractive index | 1.545 | 1.542 | 1.506 | 1.576 |
| | | melt viscosity [poise] | 362 | 352 | 515 | 2260 |
| | compatibilizer | functional group | — | — | — | — |
| | (C) | backbone chain | — | — | — | — |
| | melt viscosity ratio [—] | | 2.8 | 2.9 | 2.0 | 0.2 |
| | composite ratio | A/B/C [parts by weight] | 95.2/4.8/0.0 | 95.2/4.8/0.0 | 95.2/4.8/0.0 | 95.2/4.8/0.0 |
| | sea-island structure formation method | | alloy based | alloy based | alloy based | alloy based |
| Fiber | fineness [dtex] | | 66 | 66 | 66 | 66 |
| characteristics | number of filaments | | 36 | 36 | 36 | 36 |
| of dyeable | strength [cN/dtex] | | 4.8 | 4.7 | 4.3 | 2.4 |
| polyolefin | elongation percentage [%] | | 33 | 34 | 31 | 32 |
| false-twisted | fineness variation value U % (hi) [%] | | 1.2 | 1.3 | 1.5 | 2.0 |
| yarn | dispersed particle diameter of island component [nm] | | 280 | 310 | 550 | 720 |
| | discontinuity of island component | | Y | Y | Y | Y |
| | specific gravity | | 0.93 | 0.93 | 0.93 | 0.93 |
| | crimp recovery rate (CR) [%] | | 32 | 31 | 25 | 11 |
| | hot-water dimensional change rate [%] | | 3.0 | 3.2 | 4.0 | 6.9 |
| Fabric | L* value | | 30 | 30 | 26 | 45 |
| characteristics | color fastness to light [class] | | 4 | 4 | 3-4 | 4-5 |
| of dyeable | color fastness to washing [class] | | 4 | 4 | 3 | 4-5 |
| polyolefin | color fastness to rubbing [class] | | 4 | 4 | 3-4 | 3-4 |
| false-twisted | lightness | | S | S | S | S |
| yarn | color developability | | S | S | S | B |
| | level dyeability | | S | S | A | C |

TABLE 4-continued

| | Example 12 | Example 13 | Example 14 | Comparative example 2 |
|---|---|---|---|---|
| bulkiness | S | S | S | A |
| flexibility | S | S | S | A |
| maximum specimen temperature in oxidation exotherm test [° C.] | 150 | 150 | 150 | 150 |

PP: polypropylene,

PET: polyethylene terephthalate,

CHDC: cyclohexanedicarboxylic acid,

N.D.: not detected

TABLE 5

| | | | Comparative example 3 | Example 15 | Example 16 | Example 17 |
|---|---|---|---|---|---|---|
| Spinning temperature and melt viscosity measuring temperature [° C.] | | | 250 | 250 | 250 | 250 |
| Sea/island composite conditions | sea component (A) | type of polymer | PP | PP | PP | PP |
| | | CHDC copolymerization rate [mol %] | — | — | — | — |
| | | melting peak temperature [° C.] | 159 | 159 | 159 | 159 |
| | | aromatic ring concentration [mol/kg] | 0.00 | 0.00 | 0.00 | 0.00 |
| | | refractive index | 1.483 | 1.483 | 1.483 | 1.483 |
| | | melt viscosity [poise] | 1030 | 1030 | 1030 | 1030 |
| | island component (B) | type of polymer | — | copolymerized PET | copolymerized PET | copolymerized PET |
| | | CHDC copolymerization rate [mol %] | — | 30 | 30 | 30 |
| | | melting peak temperature [° C.] | — | N.D. | N.D. | N.D. |
| | | aromatic ring concentration [mol/kg] | — | 3.61 | 3.61 | 3.61 |
| | | refractive index | — | 1.556 | 1.556 | 1.556 |
| | | melt viscosity [poise] | — | 335 | 335 | 335 |
| | compatibilizer (C) | functional group | — | — | — | — |
| | | backbone chain | — | — | — | — |
| | melt viscosity ratio [—] | | — | 3.1 | 3.1 | 3.1 |
| | composite ratio A/B/C [parts by weight] | | 100.0/0.0/0.0 | 97.0/3.0/0.0 | 96.0/4.0/0.0 | 85.0/15.0/0.0 |
| | sea-island structure formation method | | single component | alloy based | alloy based | alloy based |
| Fiber characteristics of dyeable polyolefin false-twisted yarn | fineness [dtex] | | 66 | 66 | 66 | 66 |
| | number of filaments | | 36 | 36 | 36 | 36 |
| | strength [cN/dtex] | | 5.7 | 5.3 | 5.2 | 4.5 |
| | elongation percentage [%] | | 33 | 30 | 31 | 31 |
| | fineness variation value U % (hi) [%] | | 0.4 | 0.6 | 0.7 | 1.0 |
| | dispersed particle diameter of island component [nm] | | — | 195 | 245 | 360 |
| | discontinuity of island component | | — | Y | Y | Y |
| | specific gravity | | 0.91 | 0.92 | 0.94 | 0.97 |
| | crimp recovery rate (CR) [%] | | 38 | 35 | 28 | 20 |
| | hot-water dimensional change rate [%] | | 2.0 | 3.0 | 3.7 | 5.0 |
| Fabric characteristics of dyeable polyolefin false-twisted yarn | L* value | | 91 | 39 | 33 | 30 |
| | color fastness to light [class] | | 3 | 5 | 4-5 | 4 |
| | color fastness to washing [class] | | 2 | 4-5 | 4-5 | 4 |
| | color fastness to rubbing [class] | | 2-3 | 4-5 | 4-5 | 4 |
| | lightness | | S | S | A | A |
| | color developability | | C | A | S | S |
| | level dyeability | | B | S | S | S |
| | bulkiness | | S | S | S | S |
| | flexibility | | A | A | S | S |
| | maximum specimen temperature in oxidation exotherm test [° C.] | | 150 | 150 | 150 | 150 |

PP: polypropylene,

PET: polyethylene terephthalate,

CHDC: cyclohexanedicarboxylic acid,

N.D.: not detected

TABLE 6

| | | | Example 18 | Example 19 | Example 20 | Comparative example 4 |
|---|---|---|---|---|---|---|
| Spinning temperature and melt viscosity measuring temperature [° C.] | | | 250 | 250 | 250 | 250 |
| Sea/island composite conditions | sea component (A) | type of polymer | PP | PP | PP | copolymerized PET |
| | | CHDC copolymerization rate [mol %] | — | — | — | 30 |
| | | melting peak temperature [° C.] | 159 | 159 | 159 | N.D. |
| | | aromatic ring concentration [mol/kg] | 0.00 | 0.00 | 0.00 | 3.61 |
| | | refractive index | 1.483 | 1.483 | 1.483 | 1.556 |
| | | melt viscosity [poise] | 1030 | 1030 | 1030 | 335 |
| | island component (B) | type of polymer | copolymerized PET | copolymerized PET | copolymerized PET | PP |
| | | CHDC copolymerization rate [mol %] | 30 | 30 | 30 | — |
| | | melting peak temperature [° C.] | N.D. | N.D. | N.D. | 159 |
| | | aromatic ring concentration [mol/kg] | 3.61 | 3.61 | 3.61 | 0.00 |
| | | refractive index | 1.556 | 1.556 | 1.556 | 1.483 |
| | | melt viscosity [poise] | 335 | 335 | 335 | 1030 |
| | compatibilizer (C) | functional group | — | — | — | — |
| | | backbone chain | — | — | — | — |
| | melt viscosity ratio [—] | | 3.1 | 3.1 | 3.1 | 0.3 |
| | composite ratio A/B/C [parts by weight] | | 83.0/17/0.0 | 80.0/20.0/0.0 | 70.0/30.0/0.0 | 70.0/30.0/0.0 |
| | sea-island structure formation method | | alloy based | alloy based | alloy based | alloy based |
| Fiber characteristics of dyeable polyolefin false-twisted yarn | fineness [dtex] | | 66 | 66 | 66 | 66 |
| | number of filaments | | 36 | 36 | 36 | 36 |
| | strength [cN/dtex] | | 4.2 | 3.6 | 3.2 | 2.7 |
| | elongation percentage [%] | | 32 | 33 | 31 | 30 |
| | fineness variation value U % (hi) [%] | | 1.2 | 1.3 | 1.5 | 2.5 |
| | dispersed particle diameter of island component [nm] | | 430 | 540 | 720 | 650 |
| | discontinuity of island component | | Y | Y | Y | Y |
| | specific gravity | | 0.97 | 0.98 | 0.99 | 1.17 |
| | crimp recovery rate (CR) [%] | | 15 | 12 | 10 | 3 |
| | hot-water dimensional change rate [%] | | 5.5 | 6.5 | 7.0 | 12.5 |
| Fabric characteristics of dyeable polyolefin false-twisted yarn | L* value | | 29 | 27 | 26 | 24 |
| | color fastness to light [class] | | 4 | 3-4 | 3 | 2-3 |
| | color fastness to washing [class] | | 3-4 | 3 | 3 | 2-3 |
| | color fastness to rubbing [class] | | 3-4 | 3-4 | 3-4 | 2-3 |
| | lightness | | A | A | A | C |
| | color developability | | S | S | S | S |
| | level dyeability | | A | A | A | B |
| | bulkiness | | A | A | A | C |
| | flexibility | | A | A | A | C |
| | maximum specimen temperature in oxidation exotherm test [° C.] | | 150 | 150 | 150 | 150 |

PP: polypropylene,
PET: polyethylene terephthalate,
CHDC: cyclohexanedicarboxylic acid,
N.D.: not detected

TABLE 7

| | | | Example 21 | Example 22 | Example 23 | Example 24 |
|---|---|---|---|---|---|---|
| Spinning temperature and melt viscosity measuring temperature [° C.] | | | 250 | 250 | 250 | 250 |
| Sea/island composite conditions | sea component (A) | type of polymer | PP | PP | PP | PP |
| | | melting peak temperature [° C.] | 159 | 159 | 159 | 159 |
| | | aromatic ring concentration [mol/kg] | 0.00 | 0.00 | 0.00 | 0.00 |
| | | refractive index | 1.483 | 1.483 | 1.483 | 1.483 |
| | | melt viscosity [poise] | 1030 | 1030 | 1030 | 1030 |
| | island component (B) | type of polymer | copolymerized PET | copolymerized PET | copolymerized PET | copolymerized PET |
| | | CHDC copolymerization rate [mol %] | 30 | 30 | 30 | 30 |

TABLE 7-continued

| | | | Example 21 | Example 22 | Example 23 | Example 24 |
|---|---|---|---|---|---|---|
| | | melting peak temperature [° C.] | N.D. | N.D. | N.D. | N.D. |
| | | aromatic ring concentration [mol/kg] | 3.61 | 3.61 | 3.61 | 3.61 |
| | | refractive index | 1.556 | 1.556 | 1.556 | 1.556 |
| | | melt viscosity [poise] | 335 | 335 | 335 | 335 |
| | compatibilizer (C) | functional group | anhydride group | anhydride group | amino group | amino group |
| | | backbone chain | PP | SEBS | SEBS | SEBS |
| | melt viscosity ratio [—] | | 3.1 | 3.1 | 3.1 | 3.1 |
| | composite ratio | A/B/C [parts by weight] | 95.0/4.8/0.2 | 95.0/4.8/0.2 | 95.0/4.8/0.2 | 95.1/4.8/0.1 |
| | sea-island structure formation method | | alloy based | alloy based | alloy based | alloy based |
| Fiber characteristics of dyeable polyolefin false-twisted yarn | fineness [dtex] | | 66 | 66 | 66 | 66 |
| | number of filaments | | 36 | 36 | 36 | 36 |
| | strength [cN/dtex] | | 5.2 | 5.3 | 5.6 | 5.4 |
| | elongation percentage [%] | | 33 | 33 | 32 | 30 |
| | fineness variation value U % (hi) [%] | | 0.6 | 0.5 | 0.4 | 0.5 |
| | dispersed particle diameter of island component [nm] | | 220 | 170 | 130 | 190 |
| | discontinuity of island component | | Y | Y | Y | Y |
| | specific gravity | | 0.93 | 0.93 | 0.93 | 0.93 |
| | crimp recovery rate (CR) [%] | | 31 | 32 | 33 | 33 |
| | hot-water dimensional change rate [%] | | 3.4 | 3.3 | 3.2 | 3.2 |
| Fabric characteristics of dyeable polyolefin false-twisted yarn | L* value | | 32 | 31 | 29 | 30 |
| | color fastness to light [class] | | 4-5 | 4-5 | 4-5 | 4-5 |
| | color fastness to washing [class] | | 4-5 | 4-5 | 4-5 | 4-5 |
| | color fastness to rubbing [class] | | 4 | 4-5 | 4-5 | 4-5 |
| | lightness | | S | S | S | S |
| | color developability | | S | S | S | S |
| | level dyeability | | S | S | S | S |
| | bulkiness | | S | S | S | S |
| | flexibility | | S | S | S | S |
| | maximum specimen temperature in oxidation exotherm test [° C.] | | 150 | 150 | 150 | 150 |

PP: polypropylene,
PET: polyethylene terephthalate
CHDC: cyclohexanedicarboxylic acid,
SEBS: styrene - ethylene - butylene - styrene,
N.D.: not detected

TABLE 8

| | | | Example 25 | Example 26 | Example 27 | Example 28 |
|---|---|---|---|---|---|---|
| Spinning temperature and melt viscosity measuring temperature [° C.] | | | 250 | 250 | 250 | 250 |
| Sea/island composite conditions | sea component (A) | type of polymer | PP | PP | PP | PP |
| | | melting peak temperature [° C.] | 159 | 159 | 159 | 159 |
| | | aromatic ring concentration [mol/kg] | 0.00 | 0.00 | 0.00 | 0.00 |
| | | refractive index | 1.483 | 1.483 | 1.483 | 1.483 |
| | | melt viscosity [poise] | 1030 | 1030 | 1030 | 1030 |
| | island component (B) | type of polymer | copolymerized PET | copolymerized PET | copolymerized PET | copolymerized PET |
| | | CHDC copolymerization rate [mol %] | 30 | 30 | 30 | 30 |
| | | melting peak temperature [° C.] | N.D. | N.D. | N.D. | N.D. |
| | | aromatic ring concentration [mol/kg] | 3.61 | 3.61 | 3.61 | 3.61 |
| | | refractive index | 1.556 | 1.556 | 1.556 | 1.556 |
| | | melt viscosity [poise] | 335 | 335 | 335 | 335 |
| | compatibilizer (C) | functional group | amino group | amino group | amino group | amino group |
| | | backbone chain | SEBS | SEBS | SEBS | SEBS |
| | melt viscosity ratio [—] | | 3.1 | 3.1 | 3.1 | 3.1 |
| | composite ratio | A/B/C [parts by weight] | 94.7/4.8/0.5 | 94.2/4.8/1.0 | 88.0/10.0/2.0 | 85.0/10.0/5.0 |
| | sea-island structure formation method | | alloy based | alloy based | alloy based | alloy based |

TABLE 8-continued

| | | Example 25 | Example 26 | Example 27 | Example 28 |
|---|---|---|---|---|---|
| Fiber characteristics of dyeable polyolefin false-twisted yarn | fineness [dtex] | 66 | 66 | 66 | 66 |
| | number of filaments | 36 | 36 | 36 | 36 |
| | strength [cN/dtex] | 5.6 | 5.4 | 5.4 | 5.3 |
| | elongation percentage [%] | 30 | 33 | 31 | 32 |
| | fineness variation value U % (hi) [%] | 0.4 | 0.4 | 0.7 | 0.7 |
| | dispersed particle diameter of island component [nm] | 110 | 90 | 200 | 180 |
| | discontinuity of island component | Y | Y | Y | Y |
| | specific gravity | 0.93 | 0.93 | 0.95 | 0.95 |
| | crimp recovery rate (CR) [%] | 33 | 33 | 32 | 31 |
| | hot-water dimensional change rate [%] | 3.2 | 3.2 | 3.3 | 3.4 |
| Fabric characteristics of dyeable polyolefin false-twisted yarn | L* value | 27 | 27 | 27 | 26 |
| | color fastness to light [class] | 4-5 | 4-5 | 4-5 | 4-5 |
| | color fastness to washing [class] | 4-5 | 4 | 4 | 4 |
| | color fastness to rubbing [class] | 4-5 | 4 | 4-5 | 4-5 |
| | lightness | S | S | A | A |
| | color developability | S | S | S | S |
| | level dyeability | S | S | S | S |
| | bulkiness | S | S | S | S |
| | flexibility | S | S | S | S |
| | maximum specimen temperature in oxidation exotherm test [° C.] | 150 | 150 | 150 | 150 |

PP: polypropylene,
PMP: polymethylpentene,
PET: polyethylene terephthalate
CHDC: cyclohexanedicarboxylic acid,
SEBS: styrene-ethylene-butylene-styrene,
N.D.: not detected

TABLE 9

| | | | Example 29 | Example 30 |
|---|---|---|---|---|
| Spinning temperature and melt viscosity measuring temperature [° C.] | | | 250 | 290 |
| Sea/island composite conditions | sea component (A) | type of polymer | PP | PMP |
| | | melting peak temperature [° C.] | 159 | 232 |
| | | aromatic ring concentration [mol/kg] | 0.00 | 0.00 |
| | | refractive index | 1.483 | 1.463 |
| | | melt viscosity [poise] | 1030 | 1010 |
| | island component (B) | type of polymer | copolymerized PET | copolymerized PET |
| | | CHDC copolymerization rate [mol %] | 30 | 30 |
| | | melting peak temperature [° C.] | N.D. | N.D. |
| | | aromatic ring concentration [mol/kg] | 3.61 | 3.61 |
| | | refractive index | 1.556 | 1.556 |
| | | melt viscosity [poise] | 335 | 180 |
| | compatibilizer (C) | functional group | amino group | — |
| | | backbone chain | SEBS | — |
| | melt viscosity ratio [—] | | 3.1 | 5.6 |
| | composite ratio | A/B/C [parts by weight] | 80.0/10.0/10.0 | 95.2/4.8/0.0 |
| | sea-island structure formation method | | alloy based | alloy based |
| Fiber characteristics of dyeable polyolefin false-twisted yarn | fineness [dtex] | | 66 | 66 |
| | number of filaments | | 36 | 36 |
| | strength [cN/dtex] | | 5.3 | 2.1 |
| | elongation percentage [%] | | 28 | 28 |
| | fineness variation value U % (hi) [%] | | 0.8 | 0.7 |
| | dispersed particle diameter of island component [nm] | | 170 | 300 |
| | discontinuity of island component | | Y | Y |
| | specific gravity | | 0.95 | 0.85 |
| | crimp recovery rate (CR) [%] | | 30 | 13 |
| | hot-water dimensional change rate [%] | | 3.5 | 6.8 |

TABLE 9-continued

| | | Example 29 | Example 30 |
|---|---|---|---|
| Fabric characteristics of dyeable polyolefin false-twisted yarn | L* value | 26 | 33 |
| | color fastness to light [class] | 4 | 4-5 |
| | color fastness to washing [class] | 3-4 | 4-5 |
| | color fastness to rubbing [class] | 4 | 4 |
| | lightness | A | S |
| | color developability | S | S |
| | level dyeability | S | S |
| | bulkiness | S | A |
| | flexibility | S | A |
| | maximum specimen temperature in oxidation exotherm test [° C.] | 150 | 150 |

PP: polypropylene,

PMP: polymethylpentene,

PET: polyethylene terephthalate

CHDC: cyclohexanedicarboxylic acid,

SEBS: styrene - ethylene-butylene - styrene,

N.D.: not detected

TABLE 10

| | | | Comparative example 5 | Comparative example 6 |
|---|---|---|---|---|
| Spinning temperature and melt viscosity measuring temperature [° C.] | | | 250 | 250 |
| Sea/island composite conditions | sea component (A) | type of polymer | PP | PP |
| | | melting peak temperature [° C.] | 159 | 159 |
| | | aromatic ring concentration [mol/kg] | 0.00 | 0.00 |
| | | refractive index | 1.483 | 1.483 |
| | | melt viscosity [poise] | 1030 | 1030 |
| | island component (B) | type of polymer | copolymerized PET | copolymerized PET |
| | | CHDC copolymerization rate [mol %] | — | — |
| | | melting peak temperature [° C.] | N.D. | N.D. |
| | | aromatic ring concentration [mol/kg] | 4.59 | 3.83 |
| | | refractive index | 1.569 | 1.557 |
| | | melt viscosity [poise] | 1960 | 1460 |
| | compatibilizer (C) | functional group | anhydride group | anhydride group |
| | | backbone chain | PP | PP |
| | melt viscosity ratio [—] | | 0.5 | 0.7 |
| | composite ratio | A/B/C [parts by weight] | 95.0/4.8/0.2 | 95.0/4.8/0.2 |
| | sea-island structure formation method | | alloy based | alloy based |
| Fiber characteristics of dyeable polyolefin false-twisted yarn | fineness [dtex] | | 66 | 66 |
| | number of filaments | | 36 | 36 |
| | strength [cN/dtex] | | 3.1 | 4.1 |
| | elongation percentage [%] | | 31 | 32 |
| | fineness variation value U % (hi) [%] | | 1.0 | 1.1 |
| | dispersed particle diameter of island component [nm] | | 240 | 265 |
| | discontinuity of island component | | Y | Y |
| | specific gravity | | 0.93 | 0.93 |
| | crimp recovery rate (CR) [%] | | 11 | 16 |
| | hot-water dimensional change rate [%] | | 6.6 | 5.4 |

TABLE 10-continued

| | | Comparative example 5 | Comparative example 6 |
|---|---|---|---|
| Fabric characteristics of dyeable polyolefin false-twisted yarn | L* value | 44 | 44 |
| | color fastness to light [class] | 4 | 4 |
| | color fastness to washing [class] | 4 | 4 |
| | color fastness to rubbing [class] | 3-4 | 3-4 |
| | lightness | S | S |
| | color developability | B | B |
| | level dyeability | A | A |
| | bulkiness | A | A |
| | flexibility | A | A |
| | maximum specimen temperature in oxidation exotherm test [° C.] | 150 | 150 |

PP: polypropylene,

PET: polyethylene terephthalate,

CHDC: cyclohexanedicarboxylic acid,

N.D.: not detected

TABLE 11

| | | | Comparative example 7 | Comparative example 8 | Comparative example 9 |
|---|---|---|---|---|---|
| Spinning temperature and melt viscosity measuring temperature [° C.] | | | 250 | 250 | 250 |
| Sea/island composite conditions | sea component (A) | type of polymer | PP | PP | copolymerized PET |
| | | CHDC copolymerization rate [mol %] | — | — | 30 |
| | | melting peak temperature [° C.] | 159 | 159 | N.D. |
| | | aromatic ring concentration [mol/kg] | 0.00 | 0.00 | 3.61 |
| | | refractive index | 1.483 | 1.483 | 1.556 |
| | | melt viscosity [poise] | 1030 | 1030 | 335 |
| | island component (B) | type of polymer | copolymerized PET | copolymerized PET | PP |
| | | CHDC copolymerization rate [mol %] | 30 | 30 | — |
| | | melting peak temperature [° C.] | N.D. | N.D. | 159 |
| | | aromatic ring concentration [mol/kg] | 3.61 | 3.61 | 0.00 |
| | | refractive index | 1.556 | 1.556 | 1.483 |
| | | melt viscosity [poise] | 335 | 335 | 1030 |
| | compatibilizer (C) | functional group | — | — | — |
| | | backbone chain | — | — | — |
| | melt viscosity ratio [—] | | 3.1 | 3.1 | 0.3 |
| | composite ratio A/B/C [parts by weight] | | 95.2/4.8/0.0 | 95.2/4.8/0.0 | 4.8/95.2/0.0 |
| | sea-island structure formation method | | sea island type | sheath-core type | sheath-core type |
| Fiber characteristics of dyeable polyolefin false-twisted yarn | fineness [dtex] | | 66 | 66 | 66 |
| | number of filaments | | 36 | 36 | 36 |
| | strength [cN/dtex] | | 5.0 | 4.9 | 2.3 |
| | elongation percentage [%] | | 29 | 31 | 30 |
| | fineness variation value U % (hi) [%] | | 0.7 | 0.7 | 2.2 |
| | dispersed particle diameter of island component [nm] | | 550 | 2850 | 14800 |
| | discontinuity of island component | | N | N | N |
| | specific gravity | | 0.93 | 0.93 | 0.93 |
| | crimp recovery rate (CR) [%] | | 22 | 25 | 9.0 |
| | hot-water dimensional change rate [%] | | 4.8 | 4.0 | 6.0 |

TABLE 11-continued

| | | Comparative example 7 | Comparative example 8 | Comparative example 9 |
|---|---|---|---|---|
| Fabric characteristics of dyeable polyolefin false-twisted yarn | L* value | 59 | 74 | 70 |
| | color fastness to light [class] | 4 | 3 | 3 |
| | color fastness to washing [class] | 4-5 | 2 | 2 |
| | color fastness to rubbing [class] | 4 | 2-3 | 2 |
| | lightness | S | S | S |
| | color developability | B | C | C |
| | level dyeability | C | C | C |
| | bulkiness | S | S | B |
| | flexibility | S | S | A |
| | maximum specimen temperature in oxidation exotherm test [° C.] | 150 | 150 | 150 |

PP: polypropylene,
PET: polyethylene terephthalate,
CHDC: cyclohexanedicarboxylic acid,
N.D.: not detected

TABLE 12

| | | | Example 1 | Example 31 | Example 32 | Example 33 |
|---|---|---|---|---|---|---|
| Antioxidant | phenolic compound | product name | Cyanox1790 | Irganox1010 | Sumilizer GA-80 | Cyanox1790 |
| | | content [parts by weight] | 0.05 | 0.06 | 0.08 | 0.05 |
| | phosphorous compound | product name | Irgafos168 | Irgafos168 | Irgafos168 | Adeka Stab PEP-36 |
| | | content [parts by weight] | 0.05 | 0.05 | 0.05 | 0.05 |
| | hindered amine based compound | product name | Adeka Stab LA-81 | Adeka Stab LA-81 | Adeka Stab LA-81 | Adeka Stab LA-81 |
| | | content [parts by weight] | 0.6 | 0.6 | 0.6 | 0.6 |
| Maximum specimen temperature in oxidation exotherm test [° C.] | | | 150 | 150 | 150 | 150 |

TABLE 13

| | | | Example 34 | Example 35 | Example 36 | Example 37 | Example 38 |
|---|---|---|---|---|---|---|---|
| Antioxidant | phenolic compound | product name | Cyanox1790 | Cyanox1790 | Cyanox1790 | Cyanox1790 | not used |
| | | content [parts by weight] | 0.05 | 0.05 | 0.05 | 0.05 | — |
| | phosphorous compound | product name | Irgafos168 | Irgafos168 | Irgafos168 | Irgafos168 | not used |
| | | content [parts by weight] | 0.05 | 0.05 | 0.05 | 0.05 | — |
| | hindered amine based compound | product name | SABOSTABUV119 | CHIMASSORB2020 | TinuvinPA123 | Tinuvin249 | not used |
| | | content [parts by weight] | 0.5 | 0.5 | 0.5 | 0.5 | — |
| Maximum specimen temperature in oxidation exotherm test [° C.] | | | 150 | 150 | 150 | 150 | 167 |

TABLE 14

| | | | Example 31 | Example 32 | Example 33 | Example 34 |
|---|---|---|---|---|---|---|
| Spinning temperature and melt viscosity measuring temperature [° C.] | | | 250 | 250 | 250 | 250 |
| Sea/island composite conditions | sea component (A) | type of polymer | PP | PP | PP | PP |
| | | melting peak temperature [° C.] | 159 | 159 | 159 | 159 |

TABLE 14-continued

| | | | Example 31 | Example 32 | Example 33 | Example 34 |
|---|---|---|---|---|---|---|
| | | aromatic ring concentration [mol/kg] | 0.00 | 0.00 | 0.00 | 0.00 |
| | | refractive index | 1.483 | 1.483 | 1.483 | 1.483 |
| | | melt viscosity [poise] | 1030 | 1030 | 1030 | 1030 |
| | island component (B) | type of polymer | copolymerized PET | copolymerized PET | copolymerized PET | copolymerized PET |
| | | CHDC copolymerization rate [mol %] | 30 | 30 | 30 | 30 |
| | | melting peak temperature [° C.] | N.D. | N.D. | N.D. | N.D. |
| | | aromatic ring concentration [mol/kg] | 3.61 | 3.61 | 3.61 | 3.61 |
| | | refractive index | 1.556 | 1.556 | 1.556 | 1.556 |
| | | melt viscosity [poise] | 335 | 335 | 335 | 335 |
| | compatibilizer (C) | functional group | — | — | — | — |
| | | backbone chain | — | — | — | — |
| | melt viscosity ratio [—] | | 3.1 | 3.1 | 3.1 | 3.1 |
| | composite ratio A/B/C [parts by weight] | | 95.2/4.8/0.0 | 95.2/4.8/0.0 | 95.2/4.8/0.0 | 95.2/4.8/0.0 |
| | sea-island structure formation method | | alloy based | alloy based | alloy based | alloy based |
| Fiber characteristics of dyeable polyolefin false-twisted yarn | fineness [dtex] | | 66 | 66 | 66 | 66 |
| | number of filaments | | 36 | 36 | 36 | 36 |
| | strength [cN/dtex] | | 4.9 | 5.0 | 5.0 | 5.0 |
| | elongation percentage [%] | | 32 | 31 | 32 | 31 |
| | fineness variation value U % (hi) [%] | | 0.7 | 0.7 | 0.7 | 0.7 |
| | dispersed particle diameter of island component [nm] | | 240 | 230 | 240 | 230 |
| | discontinuity of island component | | Y | Y | Y | Y |
| | specific gravity | | 0.93 | 0.93 | 0.93 | 0.93 |
| | crimp recovery rate (CR) [%] | | 30 | 31 | 30 | 31 |
| | hot-water dimensional change rate [%] | | 3.5 | 3.4 | 3.5 | 3.4 |
| Fabric characteristics of dyeable polyolefin false-twisted yarn | L* value | | 32 | 33 | 32 | 33 |
| | color fastness to light [class] | | 4-5 | 4-5 | 4-5 | 4-5 |
| | color fastness to washing [class] | | 4-5 | 4-5 | 4-5 | 4-5 |
| | color fastness to rubbing [class] | | 4 | 4 | 4 | 4 |
| | lightness | | S | S | S | S |
| | color developability | | S | S | S | S |
| | level dyeability | | S | S | S | S |
| | bulkiness | | S | S | S | S |
| | flexibility | | S | S | S | S |
| | maximum specimen temperature in oxidation exotherm test [° C.] | | 150 | 150 | 150 | 150 |

PP: polypropylene,
PET: polyethylene terephthalate,
CHDC: cyclohexanedicarboxylic acid,
N.D.: not detected

TABLE 15

| | | | Example 35 | Example 36 | Example 37 | Example 38 |
|---|---|---|---|---|---|---|
| Spinning temperature and melt viscosity measuring temperature [° C.] | | | 250 | 250 | 250 | 250 |
| Sea/island composite conditions | sea component (A) | type of polymer | PP | PP | PP | PP |
| | | melting peak temperature [° C.] | 159 | 159 | 159 | 159 |
| | | aromatic ring concentration [mol/kg] | 0.00 | 0.00 | 0.00 | 0.00 |
| | | refractive index | 1.483 | 1.483 | 1.483 | 1.483 |
| | | melt viscosity [poise] | 1030 | 1030 | 1030 | 1030 |
| | island component (B) | type of polymer | copolymerized PET | copolymerized PET | copolymerized PET | copolymerized PET |
| | | CHDC copolymerization rate [mol %] | 30 | 30 | 30 | 30 |
| | | melting peak temperature [° C.] | N.D. | N.D. | N.D. | N.D. |
| | | aromatic ring concentration [mol/kg] | 3.61 | 3.61 | 3.61 | 3.61 |
| | | refractive index | 1.556 | 1.556 | 1.556 | 1.556 |
| | | melt viscosity [poise] | 335 | 335 | 335 | 335 |

TABLE 15-continued

| | | | Example 35 | Example 36 | Example 37 | Example 38 |
|---|---|---|---|---|---|---|
| | compatibilizer (C) | functional group | — | — | — | — |
| | | backbone chain | — | — | — | — |
| | melt viscosity ratio [—] | | 3.1 | 3.1 | 3.1 | 3.1 |
| | composite ratio A/B/C [parts by weight] | | 95.2/4.8/0.0 | 95.2/4.8/0.0 | 95.2/4.8/0.0 | 95.2/4.8/0.0 |
| | sea-island structure formation method | | alloy based | alloy based | alloy based | alloy based |
| Fiber characteristics of dyeable polyolefin false-twisted yarn | fineness [dtex] | | 66 | 66 | 66 | 66 |
| | number of filaments | | 36 | 36 | 36 | 36 |
| | strength [cN/dtex] | | 5.0 | 4.9 | 4.9 | 5.1 |
| | elongation percentage [%] | | 32 | 32 | 32 | 32 |
| | fineness variation value U % (hi) [%] | | 0.7 | 0.7 | 0.7 | 0.7 |
| | dispersed particle diameter of island component [nm] | | 240 | 240 | 240 | 240 |
| | discontinuity of island component | | Y | Y | Y | Y |
| | specific gravity | | 0.93 | 0.93 | 0.93 | 0.93 |
| | crimp recovery rate (CR) [%] | | 30 | 30 | 30 | 30 |
| | hot-water dimensional change rate [%] | | 3.5 | 3.5 | 3.5 | 3.5 |
| Fabric characteristics of dyeable polyolefin false-twisted yarn | L* value | | 32 | 32 | 32 | 32 |
| | color fastness to light [class] | | 4-5 | 4-5 | 4-5 | 4-5 |
| | color fastness to washing [class] | | 4-5 | 4-5 | 4-5 | 4-5 |
| | color fastness to rubbing [class] | | 4 | 4 | 4 | 4 |
| | lightness | | S | S | S | S |
| | color developability | | S | S | S | S |
| | level dyeability | | S | S | S | S |
| | bulkiness | | S | S | S | S |
| | flexibility | | S | S | S | S |
| | maximum specimen temperature in oxidation exotherm test [° C.] | | 150 | 150 | 150 | 167 |

PP: polypropylene,
PET: polyethylene terephthalate,
CHDC: cyclohexanedicarboxylic acid,
N.D.: not detected

TABLE 16

| | | | Example 39 | Example 40 | Example 41 | Example 42 |
|---|---|---|---|---|---|---|
| Spinning temperature and melt viscosity measuring temperature [° C.] | | | 250 | 250 | 250 | 250 |
| Sea/island composite conditions | sea component (A) | type of polymer | PP | PP | PP | PP |
| | | melting peak temperature [° C.] | 159 | 159 | 159 | 159 |
| | | aromatic ring concentration [mol/kg] | 0.00 | 0.00 | 0.00 | 0.00 |
| | | refractive index | 1.483 | 1.483 | 1.483 | 1.483 |
| | | melt viscosity [poise] | 1030 | 1030 | 1030 | 1030 |
| | island component (B) | type of polymer | copolymerized PET | copolymerized PET | copolymerized PET | copolymerized PET |
| | | CHDC copolymerization rate [mol %] | 30 | 30 | 30 | 30 |
| | | melting peak temperature [° C.] | N.D. | N.D. | N.D. | N.D. |
| | | aromatic ring concentration [mol/kg] | 3.61 | 3.61 | 3.61 | 3.61 |
| | | refractive index | 1.556 | 1.556 | 1.556 | 1.556 |
| | | melt viscosity [poise] | 335 | 335 | 335 | 335 |
| | compatibilizer (C) | functional group | — | — | — | — |
| | | backbone chain | — | — | — | — |
| | melt viscosity ratio [—] | | 3.1 | 3.1 | 3.1 | 3.1 |
| | composite ratio A/B/C [parts by weight] | | 95.2/4.8/0.0 | 95.2/4.8/0.0 | 95.2/4.8/0.0 | 95.2/4.8/0.0 |
| | sea-island structure formation method | | alloy based | alloy based | alloy based | alloy based |
| Fiber characteristics of dyeable polyolefin false-twisted yarn | fineness [dtex] | | 66 | 66 | 66 | 66 |
| | number of filaments | | 3 | 6 | 12 | 72 |
| | strength [cN/dtex] | | 5.3 | 5.2 | 5.1 | 4.8 |
| | elongation percentage [%] | | 32 | 32 | 32 | 32 |
| | fineness variation value U % (hi) [%] | | 0.4 | 0.5 | 0.6 | 1.0 |
| | dispersed particle diameter of island component [nm] | | 260 | 250 | 250 | 230 |
| | discontinuity of island component | | Y | Y | Y | Y |
| | specific gravity | | 0.93 | 0.93 | 0.93 | 0.93 |
| | crimp recovery rate (CR) [%] | | 11 | 15 | 20 | 30 |
| | hot-water dimensional change rate [%] | | 3.7 | 3.6 | 3.6 | 3.3 |

TABLE 16-continued

| | | Example 39 | Example 40 | Example 41 | Example 42 |
|---|---|---|---|---|---|
| Fabric characteristics of dyeable polyolefin false-twisted yarn | L* value | 30 | 31 | 32 | 34 |
| | color fastness to light [class] | 4-5 | 4-5 | 4-5 | 4-5 |
| | color fastness to washing [class] | 4-5 | 4-5 | 4-5 | 4-5 |
| | color fastness to rubbing [class] | 4 | 4 | 4 | 4 |
| | lightness | S | S | S | S |
| | color developability | S | S | S | S |
| | level dyeability | S | S | S | S |
| | bulkiness | A | S | S | S |
| | flexibility | A | A | S | S |
| | maximum specimen temperature in oxidation exotherm test [° C.] | 150 | 150 | 150 | 150 |

PP: polypropylene,
PET: polyethylene terephthalate,
CHDC: cyclohexanedicarboxylic acid,
N.D.: not detected

TABLE 17

| | | | Example 43 | Example 44 | Example 45 | Comparative example 10 |
|---|---|---|---|---|---|---|
| Spinning temperature and melt viscosity measuring temperature [° C.] | | | 250 | 250 | 250 | 250 |
| Sea/island composite conditions | sea component (A) | type of polymer | PP | PP | PP | PP |
| | | melting peak temperature [° C.] | 159 | 159 | 159 | 159 |
| | | aromatic ring concentration [mol/kg] | 0.00 | 0.00 | 0.00 | 0.00 |
| | | refractive index | 1.483 | 1.483 | 1.483 | 1.483 |
| | | melt viscosity [poise] | 1030 | 1030 | 1030 | 1030 |
| | island component (B) | type of polymer | copolymerized PET | copolymerized PET | copolymerized PET | copolymerized PET |
| | | CHDC copolymerization rate [mol %] | 30 | 30 | 30 | 30 |
| | | melting peak temperature [° C.] | N.D. | N.D. | N.D. | N.D. |
| | | aromatic ring concentration [mol/kg] | 3.61 | 3.61 | 3.61 | 3.61 |
| | | refractive index | 1.556 | 1.556 | 1.556 | 1.556 |
| | | melt viscosity [poise] | 335 | 335 | 335 | 335 |
| | compatibilizer (C) | functional group | — | — | — | — |
| | | backbone chain | — | — | — | — |
| | melt viscosity ratio [—] | | 3.1 | 3.1 | 3.1 | 3.1 |
| | composite ratio A/B/C [parts by weight] | | 95.2/4.8/0.0 | 95.2/4.8/0.0 | 95.2/4.8/0.0 | 95.2/4.8/0.0 |
| | sea-island structure formation method | | alloy based | alloy based | alloy based | alloy based |
| Fiber characteristics of dyeable polyolefin false-twisted yarn | fineness [dtex] | | 132 | 132 | 132 | 33 |
| | number of filaments | | 144 | 180 | 216 | 2 |
| | strength [cN/dtex] | | 4.8 | 4.6 | 4.4 | 5.4 |
| | elongation percentage [%] | | 32 | 31 | 30 | 32 |
| | fineness variation value U % (hi) [%] | | 0.9 | 1.0 | 1.2 | 1.0 |
| | dispersed particle diameter of island component [nm] | | 260 | 250 | 250 | 300 |
| | discontinuity of island component | | Y | Y | Y | Y |
| | specific gravity | | 0.93 | 0.93 | 0.93 | 0.93 |
| | crimp recovery rate (CR) [%] | | 30 | 32 | 35 | 3 |
| | hot-water dimensional change rate [%] | | 3.7 | 3.8 | 3.8 | 3.5 |
| Fabric characteristics of dyeable polyolefin false-twisted yarn | L* value | | 34 | 37 | 39 | 30 |
| | color fastness to light [class] | | 4-5 | 4-5 | 4-5 | 4-5 |
| | color fastness to washing [class] | | 4-5 | 4-5 | 4-5 | 4-5 |
| | color fastness to rubbing [class] | | 4 | 3-4 | 3-4 | 4 |
| | lightness | | S | S | S | S |
| | color developability | | S | A | A | S |
| | level dyeability | | S | A | A | S |
| | bulkiness | | S | S | S | C |
| | flexibility | | S | S | S | A |
| | maximum specimen temperature in oxidation exotherm test [° C.] | | 150 | 150 | 150 | 150 |

PP: polypropylene,
PET: polyethylene terephthalate,
CHDC: cyclohexanedicarboxylic acid,
N.D.: not detected

INDUSTRIAL APPLICABILITY

The false-twisted yarn formed mainly of a dyeable polyolefin fiber is high in lightness and also is high in vivid, deep color developability, and can serve suitably as a fiber structure. Accordingly, it can be applied to products that require lightness and color developability, apparel in particular, in addition to those uses where conventional polyolefin fibers have been adopted.

The invention claimed is:

1. A false-twisted yarn of a dyeable polyolefin fiber comprising three or more filaments of a polymer alloy fiber having a sea-island structure composed mainly of a polyolefin (A) as a sea component and a polyester (B) copolymerized with cyclohexanedicarboxylic acid as an island component, the island component having a dispersed particle diameter of 30 to 1,000 nm in fiber cross section and having physical features (1) and (2):

(1) a crimp recovery rate (CR) of 10% to 40%, and (2) hot-water dimensional change rate of 0.0% to 7.0% as determined by JIS L1013 (2010) 8.18.1.

2. The false-twisted yarn as set forth in claim 1, wherein, in the polyester (B), 10 to 50 mol % of the dicarboxylic acid component is copolymerized with cyclohexanedicarboxylic acid.

3. The false-twisted yarn as set forth in claim 1, further comprising a compatibilizer (C), wherein the polyester (B) accounts for 3.0 to 20.0 parts by weight based on 100 parts by weight total of the polyolefin (A), polyester (B), and compatibilizer (C).

4. The false-twisted yarn as set forth in claim 2, further comprising a compatibilizer (C), wherein the polyester (B) accounts for 3.0 to 20.0 parts by weight based on 100 parts by weight total of the polyolefin (A), polyester (B), and compatibilizer (C).

* * * * *